US005909977A

United States Patent [19]

Kuo

[11] Patent Number: 5,909,977

[45] Date of Patent: Jun. 8, 1999

[54] DENTIFRICE DISPENSING TOOTHBRUSH WITH REFILLABLE CARTRIDGE

[76] Inventor: Youti Kuo, 88 Foxbourne Rd., Penfield, N.Y. 14526

[21] Appl. No.: 08/829,242

[22] Filed: Mar. 31, 1997

[51] Int. Cl.[6] ..... B43K 5/02

[52] U.S. Cl. ..... 401/146; 401/150; 401/171

[58] Field of Search ..... 401/146, 149, 401/150, 288, 176, 141, 269, 134, 133; 222/207, 209

[56] References Cited

U.S. PATENT DOCUMENTS

| | | | |
|---|---|---|---|
| 5,087,143 | 2/1992 | Hertrampf | 401/146 |
| 5,096,321 | 3/1992 | Mountain | 401/149 |
| 5,346,324 | 9/1994 | Kuo | 401/146 |
| 5,393,153 | 2/1995 | Bouthillier | 401/146 |

*Primary Examiner*—David J. Walczak
*Attorney, Agent, or Firm*—Fred L. Denson

[57] ABSTRACT

A dentifrice dispensing toothbrush utilizes a refillable cartridge for storing dentifrice material and a compressible elastic button for pumping dentifrice material from the cartridge to a brush head. The refillable cartridge has special adaptive features for mounting to different sized openings of toothpaste tubes to facilitate cartridge refilling and venting entrapped air.

The essential components of the dentifrice dispensing toothbrush include 1) a brush head having an outlet opening therethrough and a series of bristles; 2) a pump assembly which has a pump chamber, an elastic compressible button and a base having a flap check valve; 3) a housing for attaching a refillable cartridge; 4) a refillable cartridge having an adaptive annular lip on its top opening for mating with the opening of a toothpaste tube and a plurality of shallow grooves for venting entrapped air, and a two-way follower disc for packing the dentifrice material. The dentifrice dispensing toothbrush optionally includes 5) a venting flip-cap for attachment to a toothpaste tube for releasing entrapped air when a cartridge is being refilled; and 6) a brush cover which seals the outlet opening of the brush head.

10 Claims, 22 Drawing Sheets

DENTIFRICE DISPENSING TOOTHBRUSH WITH REFILLABLE CARTRIDGE

BACKGROUND OF THE INVENTION

It is desirable to have a dentifrice dispensing toothbrush which uses a refillable cartridge for pumping dentifrice material to the top of a brush head. The refillable cartridge must be reusable without the need to clean after empty for repeated filling from a toothpaste tube. The steps of mounting of a refillable cartridge to a toothpaste tube and filling with the dentifrice material must be easy to perform for a person of average dexterity. The cartridge design must minimize air entrapment during filling with dentifrice material and be adaptive to different size openings of toothpaste tubes.

1. Field of the Invention

The present invention relates to a dentifrice dispensing toothbrush which pumps dentifrice material from a refillable cartridge to the brush head. In particular, the invention provides adaptive features for a refillable cartridge for mounting to small and large size openings of a variety of toothpaste tubes as well as means for minimizing and expelling entrapped air during filling of the cartridge from a toothpaste tube.

2. Description of Prior Art

In the designs of a toothpaste dispensing toothbrush as described in many patents, no design has been directed toward minimizing air entrapment during filling of a cartridge which is mounted on a toothpaste tube. For a vacuum-type pumping mechanism for a pasty dentifrice material, the presence of air pockets (or voids) in the dentifrice material reduces the pumping efficiency and can cause eventual pumping failure, which is a breakdown of the continuity of the flow of dentifrice material to the top of the brush head despite repeated pumping actions.

In filling a toothpaste cartridge from a toothpaste tube, a major source of air entrapment comes from air pockets formed at the junction of the toothpaste tube and the cartridge mounted to the tube. Also, air pockets may have existed originally inside the toothpaste tube. These air pockets must be vented out as much as possible during the filling process of the cartridge.

There has been no prior art that specifically addresses the venting of entrapped air in the filling of a toothpaste cartridge from a toothpaste tube. Many toothpaste pump dispensers are designed for one time use only and are not refillable. As typified by U.S. Pat. No. 4,301,948 by Czech et al. once a toothpaste pump dispenser is spent, the piston or follower disc reaches the end of the reservoir and blocks the entrance to the pump chamber. Since the piston is not retractable, the reservoir cannot be refilled from the bottom opening end to make a flow path to the pump chamber. Furthermore, it cannot be refilled from the spout of the pump dispenser because the flow is blocked by its one-way check valve which prevents dentifrice material from entering the reservoir.

The type of replaceable cartridge as described in U.S. Pat. No. 4,068,974 by Meyer et al. is mainly for storing liquid dentifrice and is not refillable. It does not have a follower disc required for packing the dentifrice material for vacuum pumping and it has only one opening that does not allow for venting of air inside. The Canadian Patent No. 523,340 by Vincent et al. describes a disposable toothbrush having a follower disc inside its handle for vacuum pumping of dentifrice material. The construction of the handle, which can be made separable, does not allow for venting of air during refilling and does not address the mountability to different sizes of toothpaste tube openings. In addition, the kind of replaceable toothpaste cartridge that uses a thread-type follower disc is not suitable for refilling because its follower disc cannot be pushed backward by the flow of the toothpaste during the refilling process. U.S. Pat. No. 4,384,645 describes a small size refillable toothpaste tube for conveniently storing inside a toothbrush handle for compactness; it is not for the convenience of vacuum pumping the toothpaste directly to the brush head through an internal flow channel.

U.S. Pat. Nos. 4,787,765 and 5,062,728 by Kuo describe replaceable toothpaste cartridges for vacuum pumping. Although these patents address the venting of air during insertion of a filled cartridge into the handle of a dentifrice dispensing toothbrush through holes located near the interface of the pumping chamber and the cartridge, the described venting mechanism is not applicable for the venting of entrapped air during filling of a toothpaste cartridge. Moreover, these cartridges use one-way follower discs which cannot be moved backward or removed as required for a refilling process. The kind of replaceable toothpaste cartridge disclosed in U.S. Pat. No. 5,346,324 by Kuo uses a two-way follower disc, but it does not have features for venting entrapped air during refilling and for adaptive mounting of the cartridge to different sizes of toothpaste openings.

Another desirable feature of a refillable cartridge is the use of a two-way follower disc having different friction forces in its forward and backward movements inside a cartridge tube. While maintaining the sealing capability, the friction force of the follower disc against the tube wall should be as low as possible for pumping a wide variety of dentifrice materials including those of low cohesive strength. On the other hand, sufficient friction is needed to support the weight of the dentifrice material in a filled cartridge without slipping off in a free standing position. These opposite frictional requirements as described above have not been addressed in the prior art of toothpaste dispenser designs such as in U.S. Pat. No. 4,651,904 by Schuckmann and U.S. Pat. No. 4,903,867 by Mettenbrink et al..

It is therefore an object of this invention to provide adaptive mounting features for a refillable toothpaste cartridge used on a toothpaste dispensing toothbrush to provide a snug-fit to different sizes of toothpaste tubes for filling the cartridge. It is also an object of this invention to provide design features for a refillable cartridge for venting entrapped air during the filling of the cartridge and for higher pumping efficiency. It is a further object of this invention to provide a venting flip-cap having special features for venting entrapped air in the junction area of a toothpaste tube mounted with a refillable cartridge.

SUMMARY OF THE INVENTION

In accordance with the present invention, a dentifrice dispensing toothbrush is provided with a refillable cartridge and a compressible elastic button for pumping a controlled quantity of dentifrice material in void free condition from the cartridge to the brush head. The refillable cartridge uses a two-way follower disc for packing the dentifrice material. The cartridge has a stepped mouth piece on its top opening end capable of mating with different sizes of outlet openings of a variety of toothpaste tubes, and a plurality of vent grooves on the inner wall of its bottom opening end for venting entrapped air. The invention also includes the use of a venting flip-cap for mounting a refillable cartridge to a toothpaste tube during refilling. The venting flip-cap not only is for facilitating the cartridge mounting but also is for expelling entrapped air in the enclosed junction area between the toothpaste tube and the mounted cartridge.

The essential components of the refillable dentifrice dispensing toothbrush of the present invention include 1) a brush head having a platform with an outlet opening therethrough and to which a series of bristles are attached; 2) a pump assembly which has a pump chamber and an elastic compressible button for supplying a pumping force and a base having a flap check valve; 3) a housing for attaching a refillable cartridge; 4) a refillable cartridge having an adaptive annular lip on its top opening for mating with the outlet opening of a toothpaste tube and a plurality of shallow grooves on the inner wall of its bottom opening end for venting entrapped air, and a two-way follower disc for packing and sealing the dentifrice material. The refillable dentifrice dispensing toothbrush of the invention optionally includes 5) a venting flip-cap having a threaded base for screw-on attachment to a toothpaste tube and vent grooves on its top opening rim for releasing entrapped air when inserted with a refillable cartridge, and a hinged cover having ribs mateable with the vent grooves for automatic cleaning by its closing action. It may also includes 6) a brush cover which has a slidable plug having a sealing rod insertable in the spout opening of the brush head.

When the elastic button is depressed, a pumping force is applied which causes a quantity of dentifrice material to flow from the cavity under the elastic button and from the pump chamber through a conduit to the brush head. During this time, back flow of dentifrice material from the pump chamber is prevented by a one-way check valve which is positioned at the base of the pump chamber. Upon release of the pumping force, the elastic button returns to its original shape due to its resilient nature. This springback action creates a vacuum force which causes dentifrice material to flow into the cavity of the compressible elastic button. Concurrently, because of the required continuity of flow of material, a quantity of dentifrice material moves from the reservoir in the cartridge in the handle into the pump chamber which in turn causes forward movement of the follower disc since it is under the atmospheric pressure. The volume of dentifrice material that is displaced by the advancement of the follower disc is equivalent to the volume dispensed to the brush head. The forward movement of the follower disc keeps the remaining dentifrice material in a packed condition.

To further ensure smooth and reliable pumping for continuous and non-interrupted flow of dentifrice material from a refillable cartridge to the brush head, the dentifrice material stored in the cartridge must be free from air pockets or voids. The presence of air pockets or voids reduces the vacuum force needed to pull the follower disc forward to maintain the packed condition of the dentifrice material. To minimize air entrapment and to stabilize the mounting of a refillable cartridge on a toothpaste tube for filling, the top opening of the cartridge has a stepped mouth piece for inserting and mating with the inner wall of the outlet opening of a toothpaste tube. Since there are two standard sizes of outlet openings in toothpaste tubes available in the marketplace, the two outside diameters of the stepped annular rims are defined to provide a snug-fit with the two corresponding sizes of the toothpaste tube openings. A single tapered annular rim can serve the same purpose but it is not as stable due to less contact surface. Moreover, the stepped mouth piece and the cartridge are preferably made from flexible plastic material by injection molding that allows for more dimensional tolerance for a snug-fit.

Prior to mounting a refillable cartridge onto a toothpaste tube, as a first step, a toothpaste tube should be rolled up and squeezed to push the front of the toothpaste to the top of the outlet opening to expel the air in that area. Next, the top opening end of a refillable cartridge having its follower disc at its foremost forward position is inserted onto the outlet opening of the toothpaste tube. These pre-filling steps can minimize the air entrapment in the junction area between the toothpaste tube and the cartridge. Then, by squeezing on the toothpaste tubes the incoming toothpaste can push the follower disc toward the bottom opening end of the cartridge. During this filling process, there is a possibility of the appearance of air pockets in the incoming toothpaste flow which are originally residing within the toothpaste tube. These entrapped air pockets may move to the flow front and congregate to create a larger air pocket there. This larger air pocket remains inside the cartridge contained by the follower disc until it escapes through the clearance, if any, between the walls of the follower disc and the cartridge. Since the follower disc is designed for slidable sealing of the dentifrice material, the air pocket can hardly leak through in the middle of the cartridge. In order to vent the entrapped air pocket, the bottom opening end of the refillable cartridge is provided with a number of shallow grooves on its interior wall. The depth of these vent grooves is sufficiently small to prevent leakage of paste-like dentifrice material yet allow air to escape. The length of the vent grooves extending from the bottom end of the cartridge is longer than the height of the follower disc so that the inward opening ends of the vent grooves are exposed to the air pocket as the rest of the vent grooves are being covered by the follower disc reaching the bottom end of the cartridge at the end of the filling process.

To prevent over-filling that causes the follower disc to come out from the cartridge, a refillable cartridge is provided with an end cap, which has a smaller opening area for blocking further movement of the follower disc when it reaches the bottom opening end of the cartridge. The construction of the end cap allows for sufficient clearance for the air to leak through the vent grooves at the bottom edge of the cartridge. Moreover, the end cap is detachable for removing the follower disc for cleaning after repeated uses and refillings as necessary.

As mentioned previously, eliminating air entrapment in the outlet opening area of a toothpaste tube for filling a cartridge requires a user to roll up and squeeze a toothpaste tube to push the toothpaste forward to the brink of the top opening of the tube. To avoid this cumbersome step, which is often ignored by users, a venting flip-cap is provided as a refilling adaptor for capping on a toothpaste tube. In addition to inner threads on its bottom opening end for screw-on onto a toothpaste tube and an hinged cover for enclosing on its top opening end, the venting flip-cap has a number of shallow grooves on the interior wall of its top opening and corresponding mating ribs on its hinged cover. When inserted with the stepped mouth piece of a refillable cartridge for filling, these shallow grooves become vent channels for venting the entrapped air. The venting function of these shallow grooves is similar to that of the vent grooves at the bottom end of the refillable cartridge. Furthermore, these vent grooves remain unclogged as they are to be mated with the corresponding ribs built on the hinged cover when it is closed. Closing action of the hinged cover automatically wipes off any residual toothpaste remaining in the vent grooves from possible prior direct dispensing; thus it keeps the air passage free of toothpaste for the next refilling of a cartridge. The venting feature of the refillable cartridge and the method of mounting a refillable cartridge on a toothpaste tube with the use of the venting flip-cap as a refilling adaptor for filling the cartridge constitutes a refilling system that can eliminate the entrapment of air during filling of the cartridge.

DETAILED DESCRIPTION OF THE EMBODIMENTS

Figure 1A:
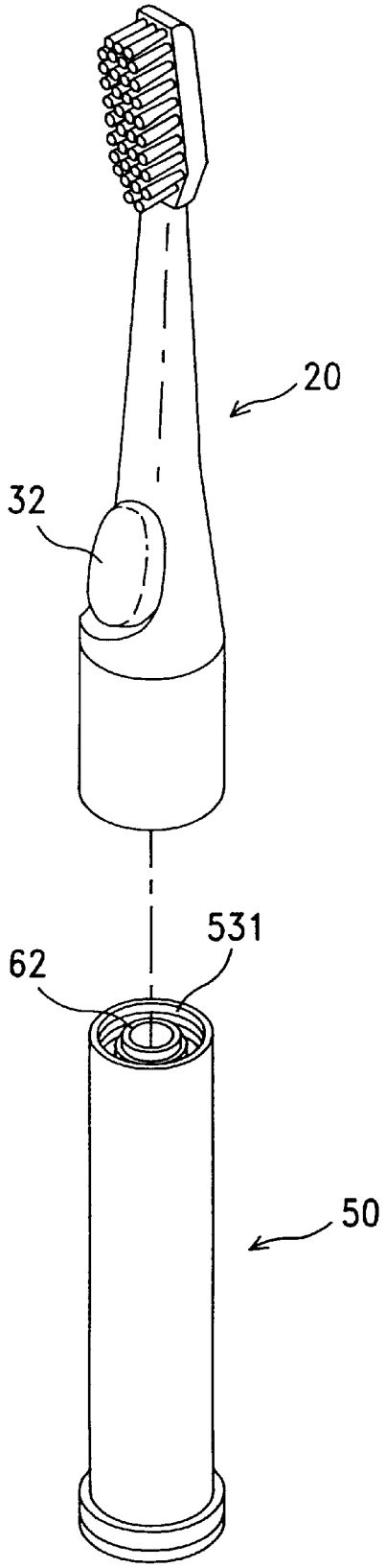
FIG. 1*a* is a perspective view of the dentifrice dispensing toothbrush of this invention with the refillable cartridge separated from the brush head housing.
Figure 1B:
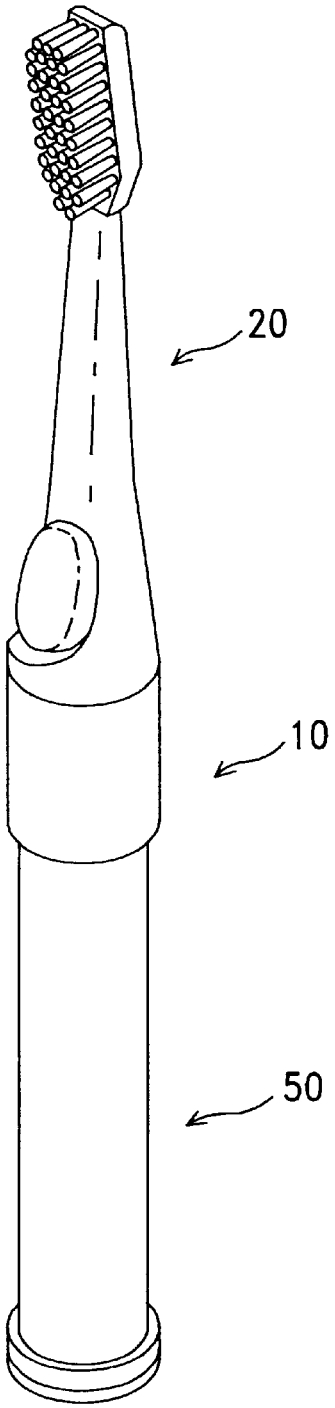
FIG. 1*b* is a perspective view of the dentifrice dispensing toothbrush of FIG. 1*a* with the refillable cartridge attached to the brush head housing.
Figure 2:
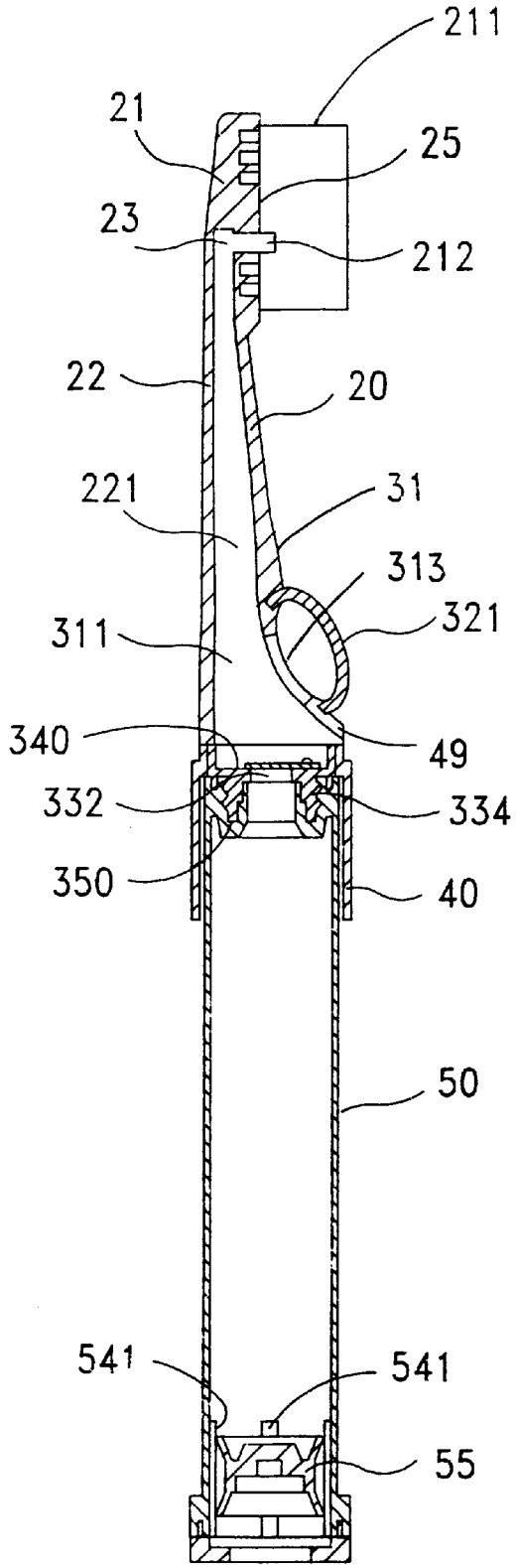
FIG. 2 is a section view of an assembled toothbrush of FIG. 1*b* showing threaded connection between the brush head housing and the refillable cartridge.
Figure 3:
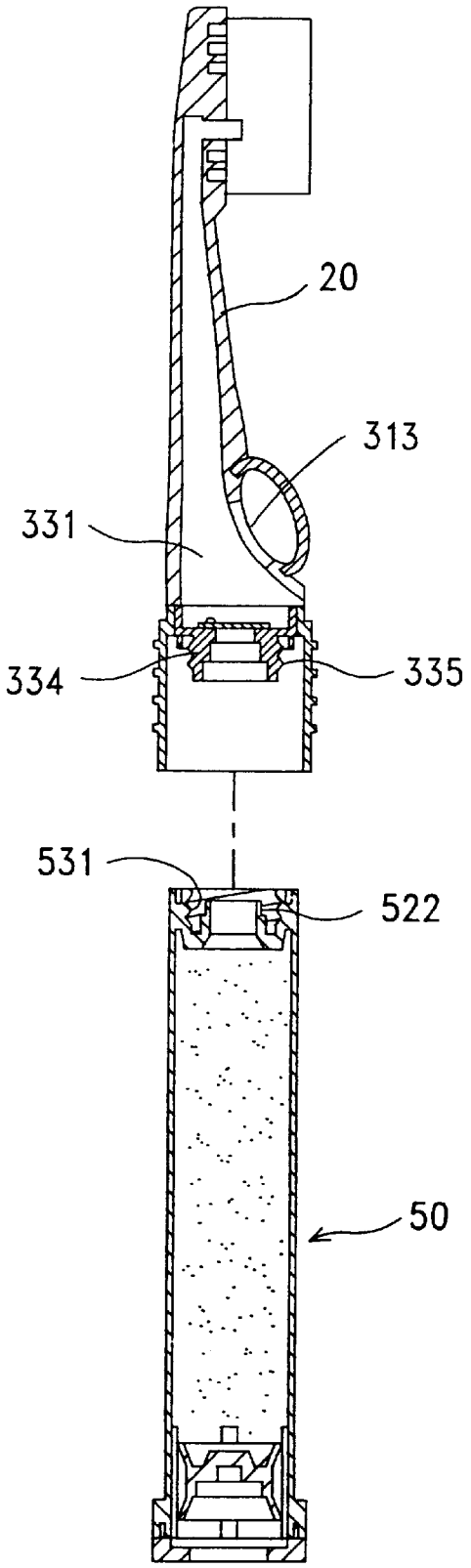
FIG. 3 shows a filled toothpaste cartridge and an unfilled brush head housing prior to priming.
Figure 4A:
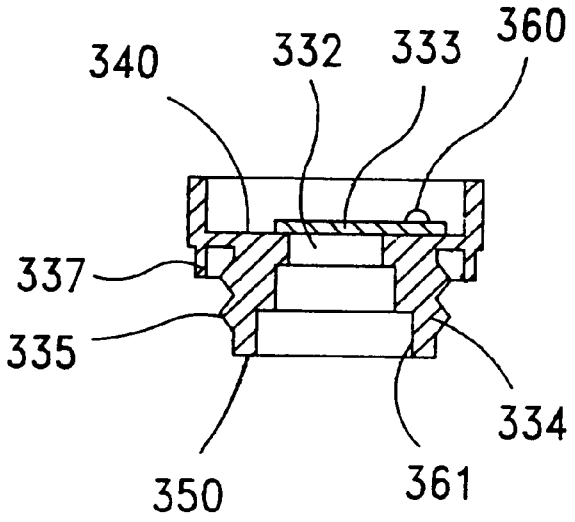
FIG. 4*a* is a section view of a pump chamber base which shows a one-way flap check valve in a closed position as used in the toothbrush shown in FIG. 2.
Figure 4B:
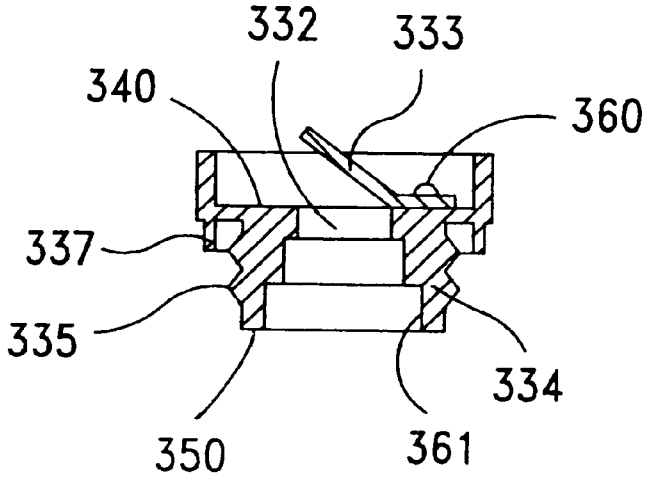
FIG. 4*b* is a section view of a pump chamber base which shows a check valve in an open position as used in the toothbrush shown in FIG. 2.

One embodiment of the dentifrice dispensing toothbrush of this invention includes a brush head housing assembly and a refillable toothpaste cartridge. FIG. 1*b* shows dentifrice dispensing toothbrush 10 having refillable cartridge 50 attached to brush housing assembly 20 and FIG. 1*a* shows refillable cartridge 50 being detached from brush head housing assembly 20. As shown in FIG. 2, brush head housing assembly 20 consists of brush head 21 having platform 25 with bristles 211 and outlet opening 212, neck 22 having conduit 221, pump assembly 31, and handle housing 40. Pump assembly 31 has pump chamber 311 which is in communication with conduit 221, opening 332 in its base 334 which has interior surface 340 and exterior surface 350 (FIG. 4*a*), and resilient elastic button 321 which is attached to opening 313 on sidewall 49. Dentifrice material is stored in refillable cartridge 50 which is attachable to brush head housing assembly 20. Resilient elastic compressible button 321 is used to supply a pumping force which causes dentifrice material (not shown) to flow from cartridge 50 to brush head 21. FIG. 3 shows separated views of a filled refillable cartridge 50 and an unfilled brush head housing assembly 20 prior to priming to illustrate the positions of interior threads 531 on cartridge 50 and exterior threads 335 on base 334 of the pump chamber. Exterior threads 335 and interior threads 531 are mateable to fasten cartridge 50 to brush head housing assembly 20. FIGS. 4*a* and 4*b* respectively show isolated views of closed and opened positions of flap check valve 333 against opening 332 in base 334 of the pump chamber. Flap check valve 333 is movably attached to hinge 360 which is fastened to base 334. When a pumping force is applied by depressing button 321, flap check valve 333 is at the closed position and is in the open position when the pumping force is released. The exterior surface of base 334 has a stepped recess 361 for matching with stepped annular lip 522 of the cartridge 50 as shown in FIG. 3, which is mateable with the opening of a toothpaste tube as will be described in a later section. Also, as shown in FIGS. 4*a* and 4*b,* outer annular rim 337 on the exterior surface 350 of base 334 is mateable with first annular groove 53 of cartridge 50 (FIGS. 5*a*) for structural support and additional sealing of the dentifrice material.

Figure 5A:
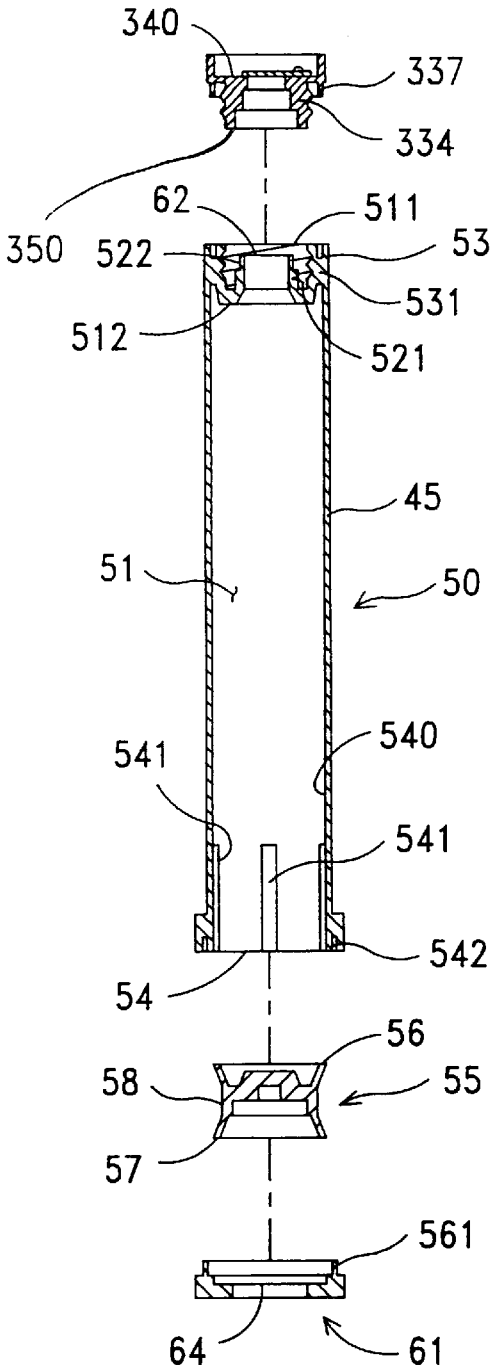
FIG. 5*a* shows a pump chamber base and unassembled components of a refillable cartridge.
Figure 5B:
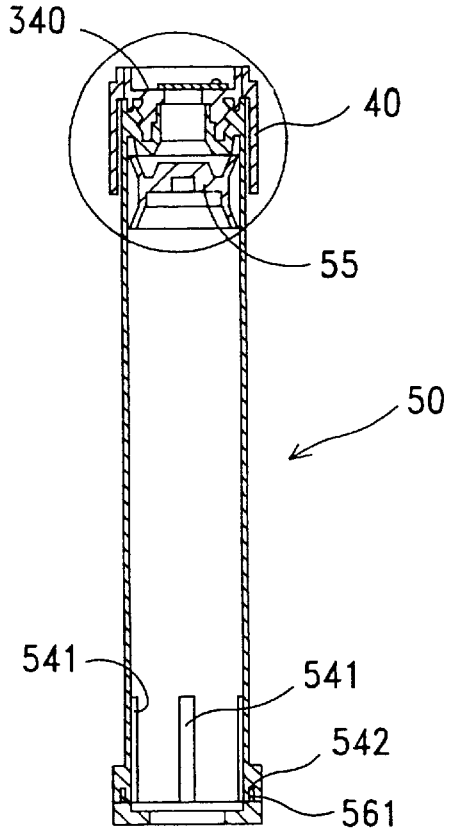
FIG. 5*b* and FIG. 5*c* show section views of an assembled pump chamber and empty cartridge with the follower disc at the top opening end of the cartridge.
Figure 5C:
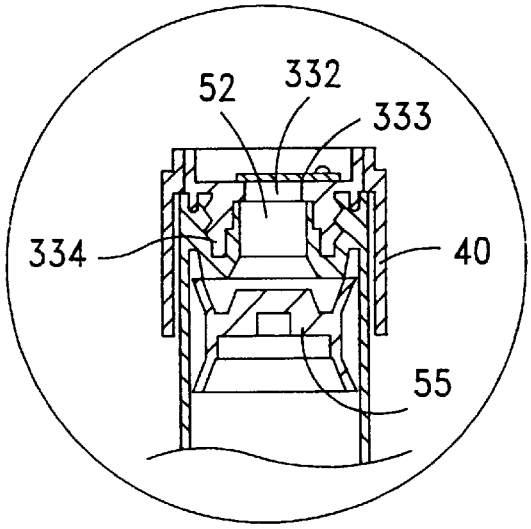
Figure 5E:
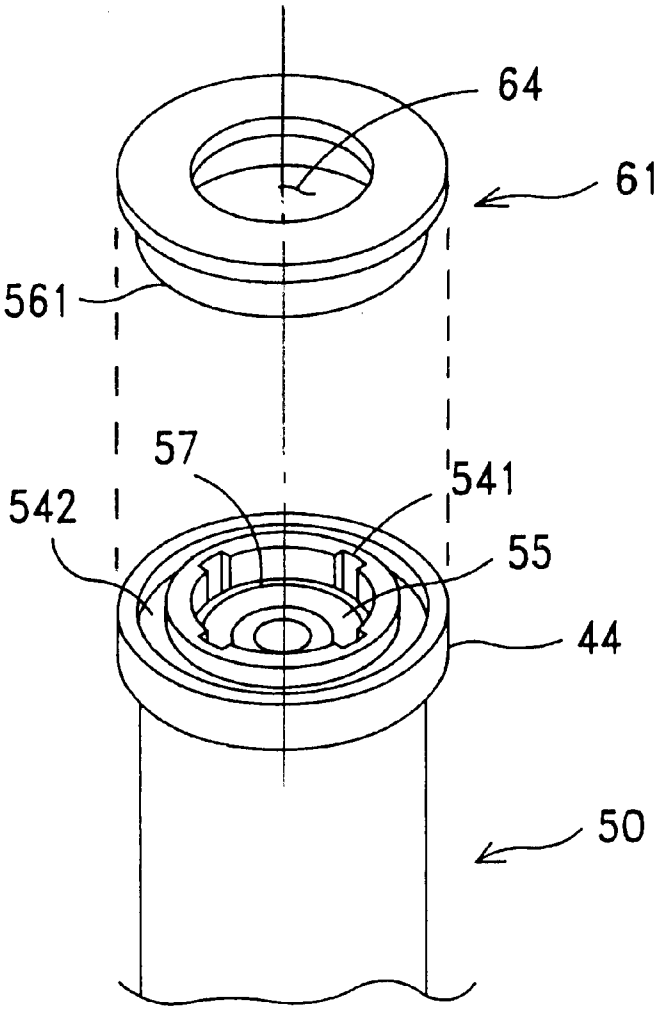
FIG. 5*e* is a perspective view of an end cap and a partial perspective view of a refillable cartridge which shows the engagement of the vent grooves and the follower disc positioned at the bottom opening end of the cartridge.
Figure 5D:
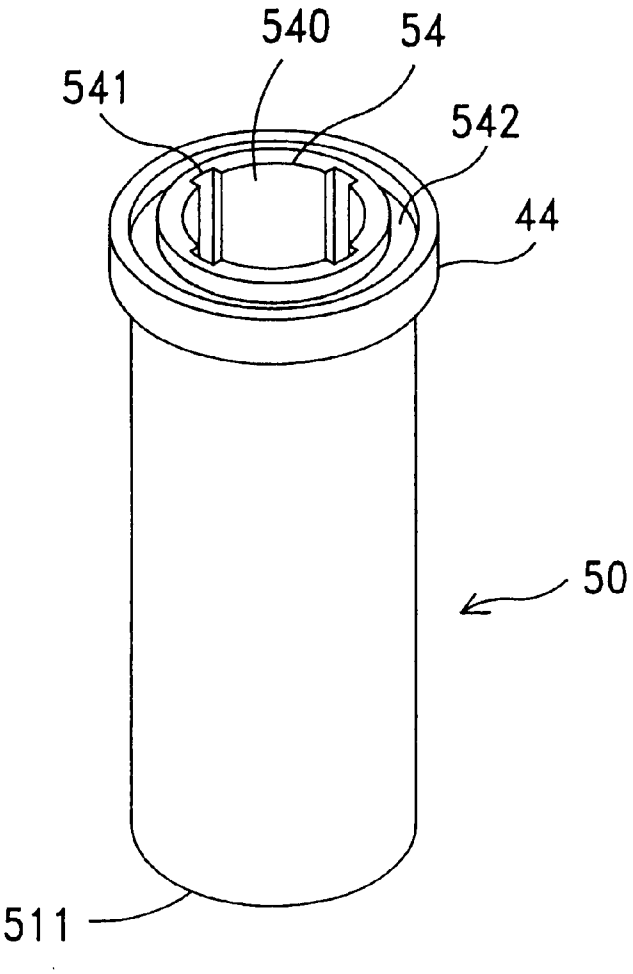
FIG. 5*d* is a perspective view of a refillable cartridge which shows the vent grooves at the bottom opening end of the cartridge with the end cap removed.

FIG. 5*a* shows the basic unassembled components of a refillable cartridge used in one embodiment of this invention. In this embodiment refillable cartridge 50 consists of a cylindrical tube 45 having interior threads 531 on its top opening end 511, a number of shallow vent grooves 541 on the inner surface 540 of its bottom opening end 54, a slidable two-way follower disc 55 and an end cap 61. As shown in FIGS. 5*b* and 5*c,* first annular groove 53 on the top opening end 511 (FIG. 5*a*) is engaged with the outer annular rim 337 on the exterior surface 350 of base 334 (FIGS. 4*a* and 4*b*). FIG. 5*b* shows a number of vent grooves 541 at bottom opening end 54 of cartridge 50. The length of vent grooves 541 is slightly greater than the height of the follower disc 55 (FIG. 5*a*). The height of follower disc 55 is defined as the distance (in the axial direction of the cylindrical tube) between the two parallel planes of the edges of upper and lower annular rims 56 and 57. The second annular groove 542 on base 44 of cartridge 50 is for mating with the corresponding annular rib 561 on the end cap 61 for fastening as shown in FIGS. 5*d* and 5*e*.

Follower disc 55 has upper annular rim 56 and lower annular rim 57 positioned at the ends of cylindrical body 58 as shown in FIG. 5*a*. Follower disc 55 is inserted into the cylindrical tube 45 through the bottom opening 54 of cartridge 50 to provide slidable sealing of the dentifrice material. Each annular rim has a shape which is conformable to the inner surface 540 of cylindrical tube 45. Both annular rims are flexible. In its free state when not placed inside a cartridge, the outside diameter of the upper annular rim 56 facing the top opening end is minutely smaller than that of the inner wall 540 of the cylindrical tube while the outside diameter of lower annular rim 57 facing the bottom opening end 54 is slightly larger than that of said inner surface 540. Because of the interactions of the plowing action of the angled annular rims 56 and 57 as well as the deflection of the tip of said lower annular rim 57 due to its over-sized diameter, the frictional resistance on follower disc 55 for forward movement is much less than that for the backward movement. While maintaining its sealing capability due to its close contact with the inner surface 540, follower disc 55 enables pumping of a wide variety of dentifrice materials including those of low cohesive strength because of its lower friction resistance for forward movement. The oversize of the outside diameter of lower annular rim 57 is determined by the requirement that the friction force between inner surface 540 of cartridge 50 and follower disc 55 be able to support the weight of the dentifrice material. No slippage of the follower disc under the gravity force is required for free handling of a filled cartridge when the cartridge is not covered or attached to the pump chamber base of a toothbrush as described.

Figure 6B:
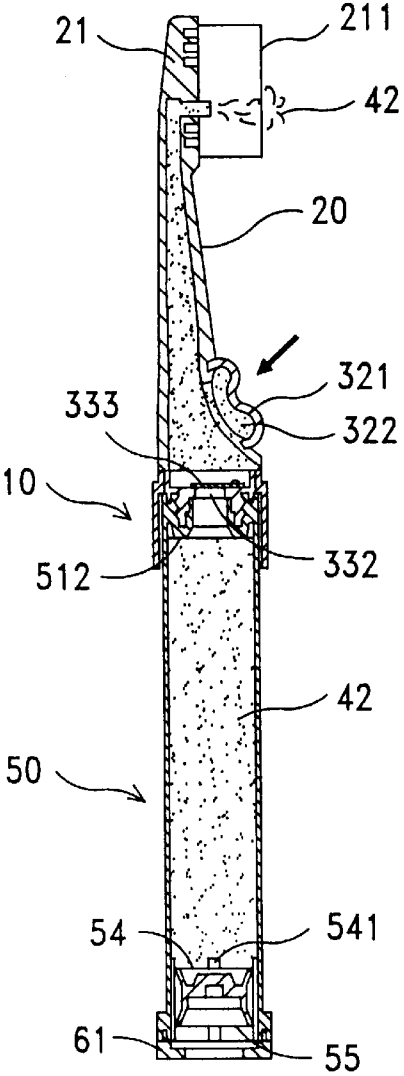
FIG. 6*a* through FIG. 6*d* are section views of one embodiment of the toothbrush of this invention showing the relative positioning of parts for each step of an operating cycle.
Figure 6A:
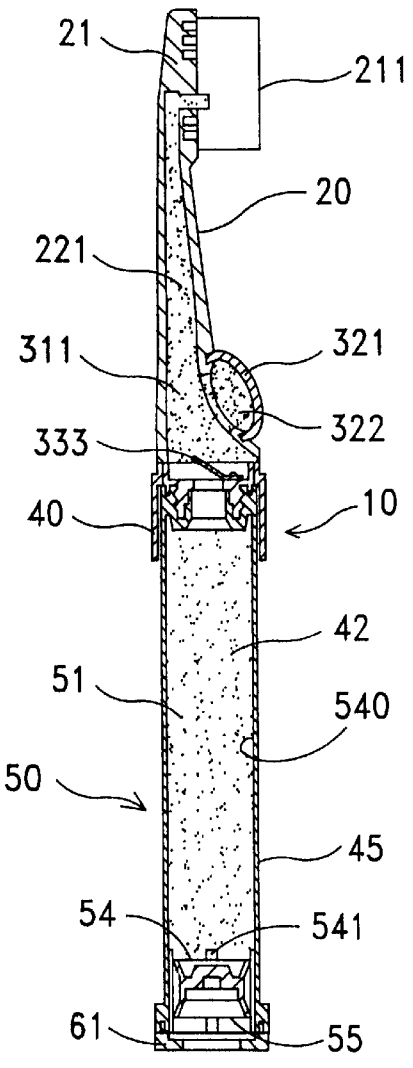
Figure 6D:
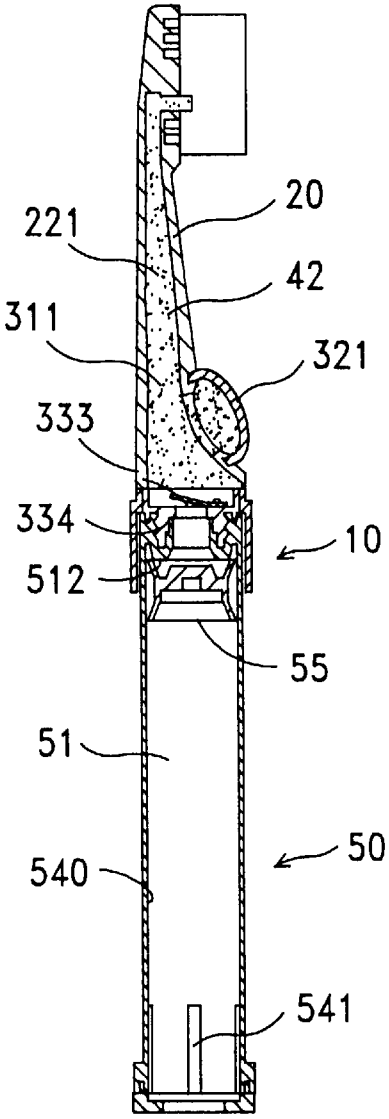
Figure 6C:
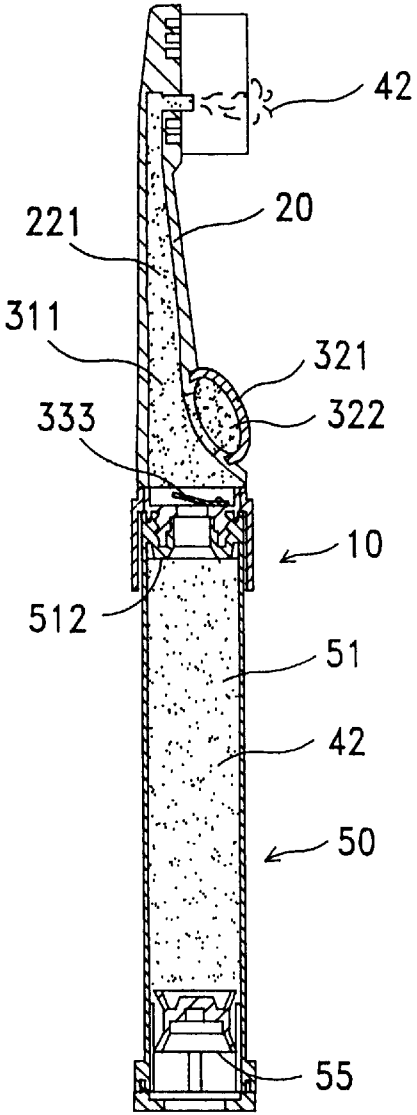

FIGS. 6*a* through 6*c* show the sequential positions of the components for one operating cycle of toothbrush 10, which has been pre-filled with dentifrice material 42. In the first stage, FIG. 6*a,* compressible elastic button 321 is in a non-pumping position and is maintained in its fully extended position due to its elastic nature. Check valve 333 is in its open position as a result of filling the toothbrush with the dentifrice material. In the second stage, FIG. 6*b,* compressible elastic button 321 is pressed down to cause dentifrice material to flow from the pump chamber to bristles 211 and at the same time cause flap check valve 333 to close the first opening 332 so as not to move follower disc 55 backward. The quantity of the dentifrice material dispensed to the brush head is the same as the displacement volume of the cavity 322 of compressible elastic button 321 during one pumping sequence.

In the third stage, as shown in FIG. 6*c,* the compressing force which had been applied to the compressible elastic button 321 is released, button 321 returns from its compressed position to its original shape because of the resiliency and memory of the material from which it is made. At the same time, the dentifrice material in cavity 322, pump chamber 311 and in cartridge reservoir 51 moves with compressible elastic button 321 and at the same time the follower disc 55 advances to a new forward position that keeps the dentifrice material in a packed condition. In all of these movements and during the elastic recovery of button 321, the dentifrice material is under a stretching condition between the pulling force of compressible elastic button 321 and the resistance force of follower disc 55. Void formation in the dentifrice material caused by such stretching is reduced or eliminated if the resistance to the forward movement of the follower disc is minimized.

Additional quantities of dentifrice material are dispensed through repeated pumping actions. In each pumping action, follower disc 55 is advanced inside of cartridge 50 toward pump chamber 311 as dentifrice material is pumped therefrom. As shown in FIG. 6*d,* follower disc 55 reaches its terminal position 512 at top opening end 511 (FIG. 5*a*) when cartridge 50 becomes empty. The empty state can be observed through side vent holes (not shown) on the handle housing 40 just below the interface of pump chamber base 334 and top opening end 511 of cartridge 50, or it can be observed through a transparent handle wall if a clear plastic material is used. When a spent cartridge is being removed, air can get through side vent holes or through the clearance between handle housing 40 and the cartridge wall into the space between cartridge 50 and pump chamber base 334 so as to break the vacuum force to prevent pulling of residual dentifrice material from the top opening end of the cartridge.

Figure 7A:
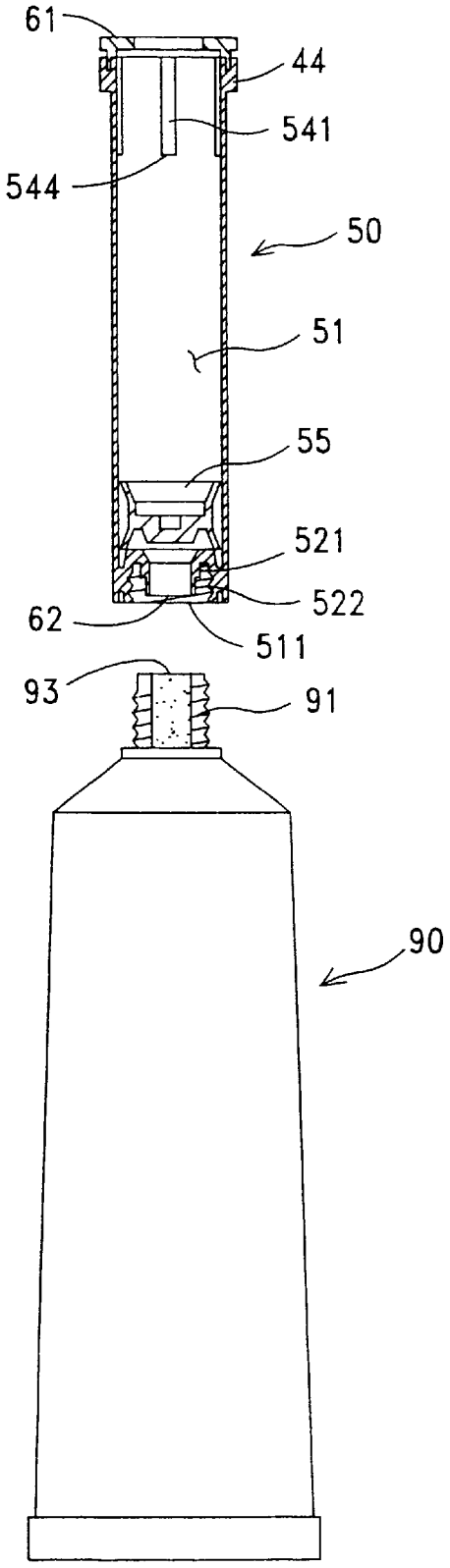
FIG. 7*a* shows an empty refillable cartridge having its follower disc at the top opening end of the cartridge prior to mounting onto a toothpaste tube.
Figure 7B:
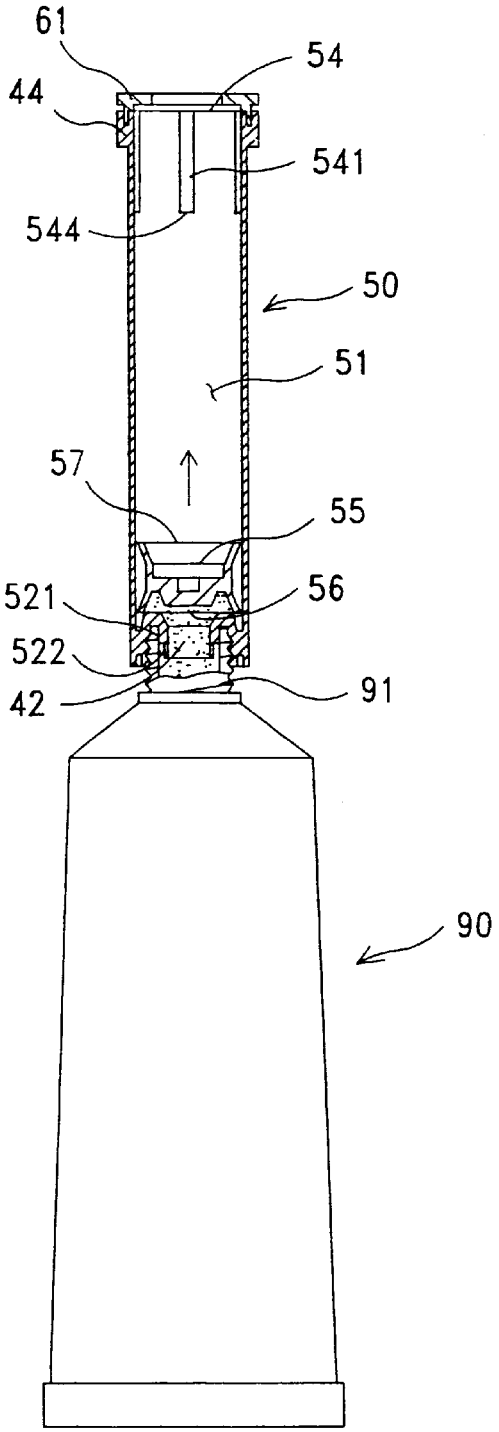
FIG. 7*b* shows the mounting of a refillable cartridge with a stepped annular lip having the larger outside diameter matched with the inside diameter of a larger outlet opening of a toothpaste tube.
Figure 7C:
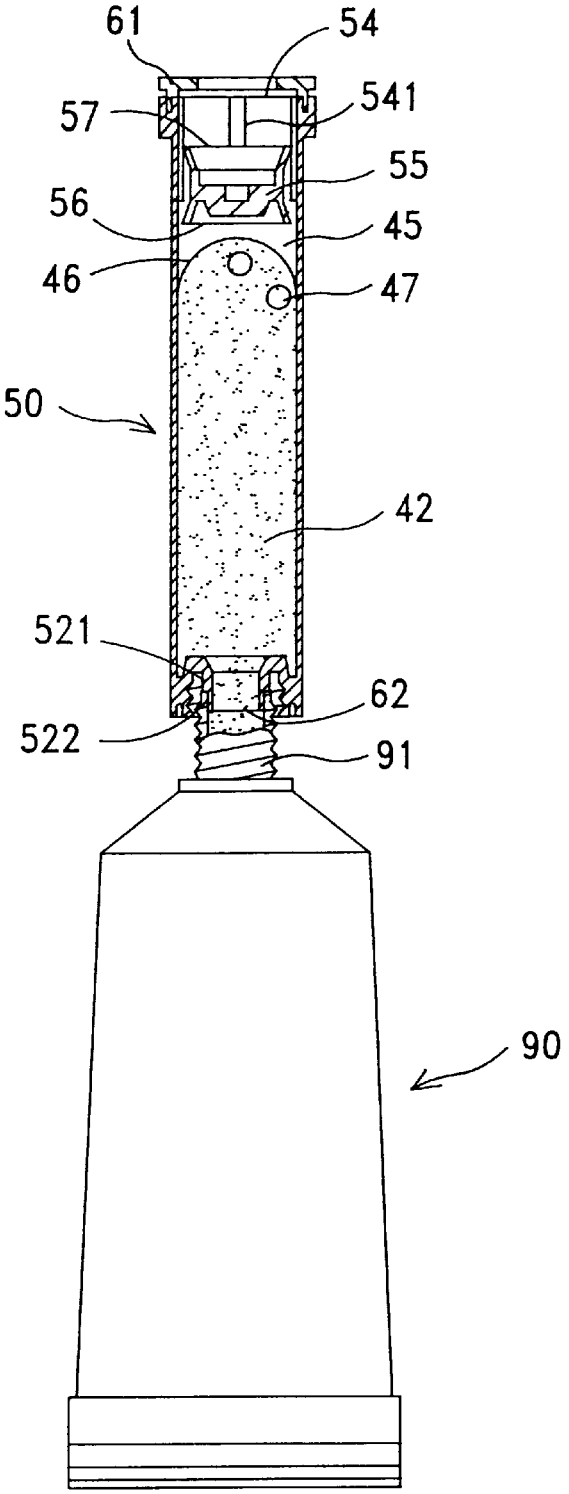
FIG. 7*c* shows the mounting of a refillable cartridge with a stepped annular lip having the smaller outside diameter matched with the inside diameter of a smaller outlet opening of a toothpaste tube.

Before mounting a refillable cartridge to a toothpaste tube for filling, the toothpaste tube 90 needs to be rolled up and squeezed to push the toothpaste to the brink of the tube outlet opening 93 to expel air inside the opening as shown in FIG. 7*a*. Next, a refillable cartridge 50 having follower disc 55 at the foremost position at the top opening end 511 is mounted to a toothpaste tube 90 by inserting the stepped annular lip 62 at top opening end 511 of said cartridge 50 onto outlet opening 93 of said toothpaste tube 90. Either the smaller, first annular rim 522 of the stepped annular lip 62 can snug-fit into outlet opening 93 of the toothpaste tube as shown in FIG. 7*c* or the larger, second annular rim 521 is fitted into said opening as shown in FIG. 7*b*. The diameters of said first and second annular rims are predetermined to fit standard small and large size openings for toothpaste tubes. The thin walls of the annular rims are preferably made of a flexible plastic material to enable them to be pressed into the outlet opening of a toothpaste tube for more stable mounting. Alternatively, each rim of stepped annular lip 62 may be slightly tapered to form a conical shape for easy insertion and to accommodate for any slight deviation from a nominal diameter of the spout opening of a toothpaste tube.

Figure 7D:
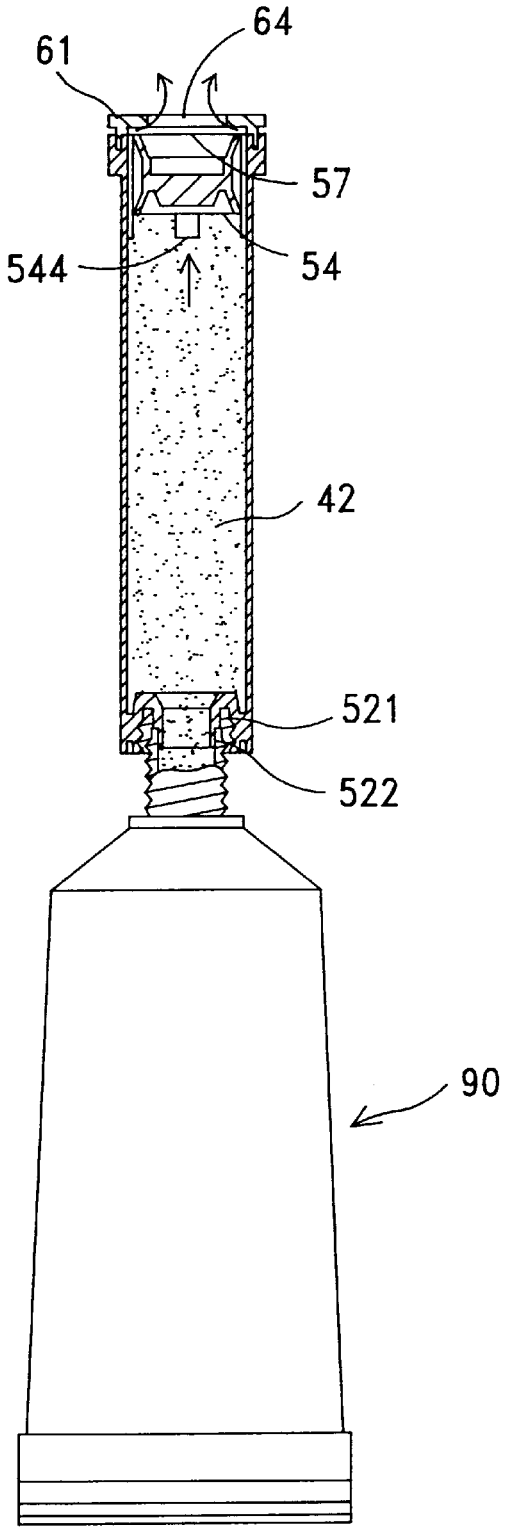
FIG. 7*d* is a schematic view showing the venting of air when the follower disc reaches the bottom opening end of the refillable cartridge.

With reference to FIG. 7*b*, being mounted with refillable cartridge 50, toothpaste tube 90 is squeezed to push toothpaste 42 into cartridge 50. The incoming flow forces follower disc 55 to move toward the bottom opening end 54 of said cartridge. Toothpaste 42 cannot leak through follower disc 55 due to the sliding fit of its upper and lower annular rims 56 and 5. Continuous squeezing of the toothpaste tube forces entrapped air pockets 47 inside the cartridge as shown in FIG. 7*c* to migrate to the flow front 46 to become a larger air pocket 45 under the follower disc 55 until follower disc 55 is blocked by end cap 61, which is fastened to flanged base 44 at bottom opening end 54 of cartridge 50. By that time, air pocket 45 has been released through vent grooves 541 whose inward ends 544 are exposed to air pocket 45 as shown in FIG. 7*d*. The length of the vent grooves 541 extending from the bottom opening end 54 of the cartridge is greater than the height of the follower disc 55 such that air pocket 45 is vented out at the bottom opening end 54 as shown in FIG. 7*d* through the grooves when the lower annular rim 57 of follower disc 55 reaches this terminal position. The paste-like dentifrice material cannot leak through vent grooves 541 because of their shallow depth and long length, which are covered by follower disc 55 at the end of the filling process.

End cap 61 shown in FIG. 7*d* has a smaller opening area 64 for exposing to the atmospheric pressure and for blocking follower disc 55. Referring once again to FIG. 5*e*, end cap 61 has an annular rib 561 for inserting into the corresponding second annular groove 542 on flanged base 44 for fastening to cartridge 50. The height of the annular rib 561 is greater than the depth of the annular groove 542 to provide a clearance for the escape of air pocket 45 released from vent grooves 541. Furthermore, end cap 61 is detachable to allow removal of follower disc 55 for cleaning any residual toothpaste after repeated uses and refillings as necessary.

Figure 7E:
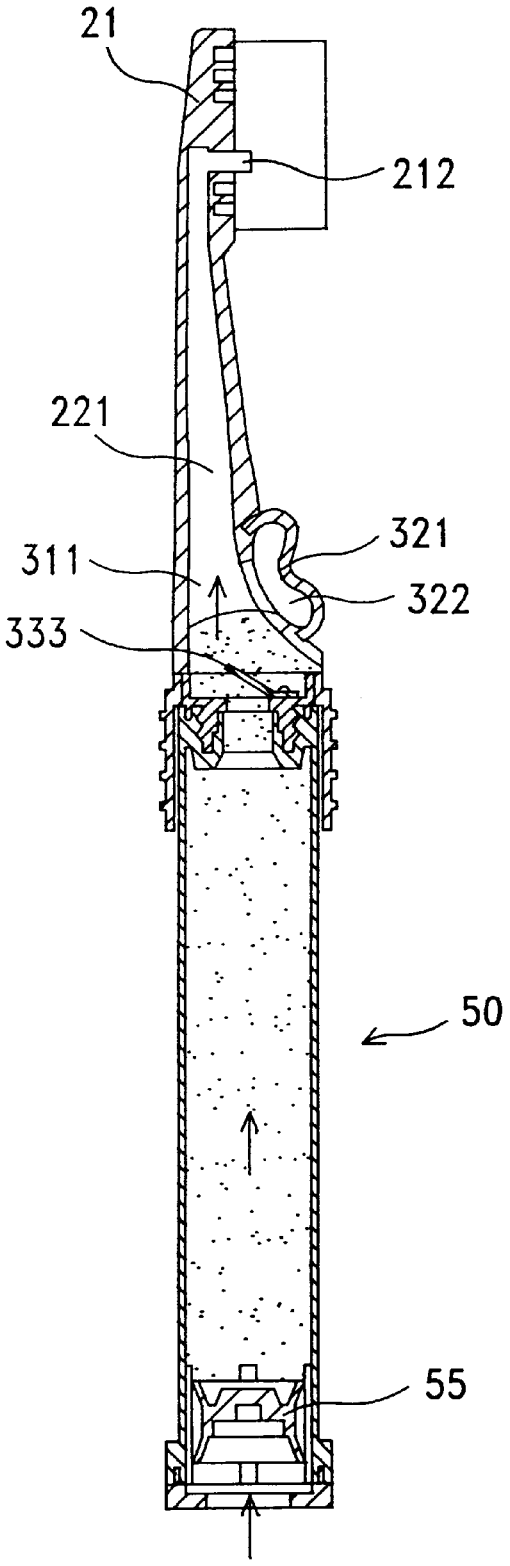
FIG. 7*e* shows the flow of dentifrice material during priming of a toothbrush with a refillable cartridge.

A filled cartridge is attachable to the brush head housing by screwing the cartridge onto the threaded base of the pump chamber. To prime an empty toothbrush as shown in FIG. 7*e*, one needs to push follower disc 55 forward to force dentifrice material to flow through one-way check valve 333 into pump chamber 311 and cavity 322 of button 321, and through conduit 221 to spout opening 212 of brush head 21. It is preferable to hold down button 321 to avoid air entrapment in the cavity 322 of button 321 during the priming step. This priming step prepares the toothbrush to be ready for use. Once the flow path of the toothbrush is fully filled, the toothpaste is pumped out onto bristles 211 by pressing down the button as described previously.

Figure 8B:
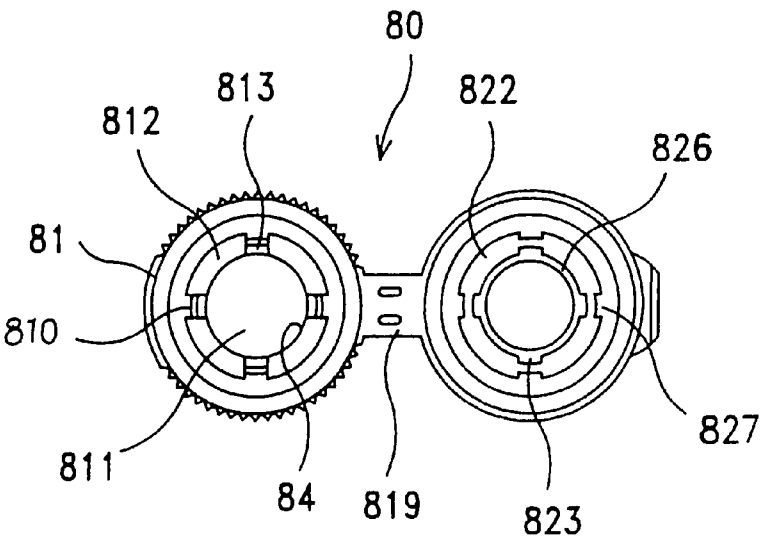
FIG. 8*b* shows a top view of the flip-cap shown in FIG. 8*a*.
Figure 8A:
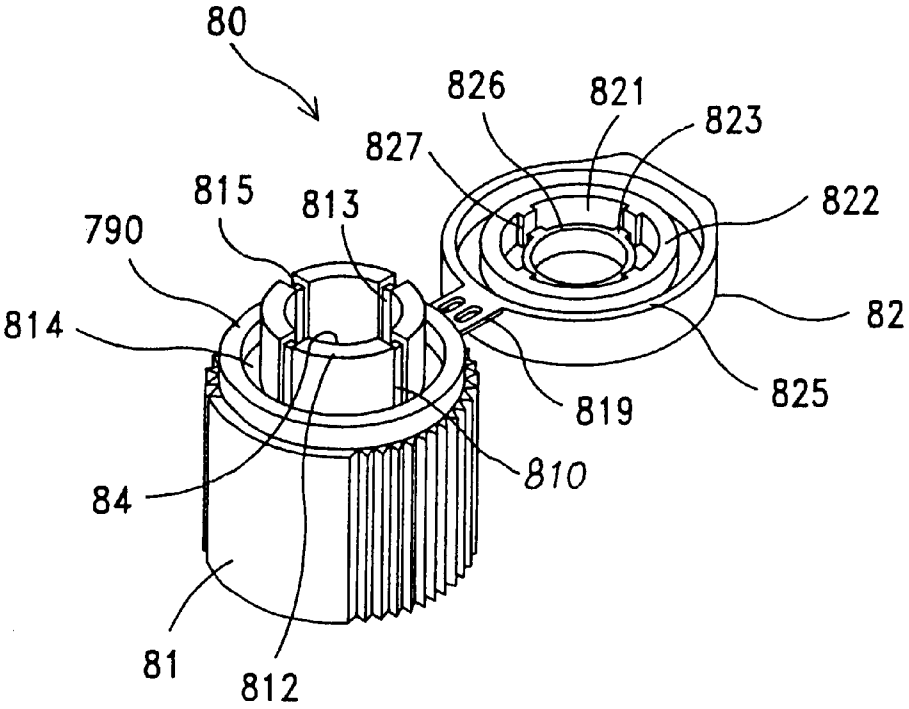
FIG. 8*a* is a perspective view of a venting flip-cap which shows vent grooves on the interior wall of its top opening end and corresponding mating ribs on its hinged cover.
Figure 8D:
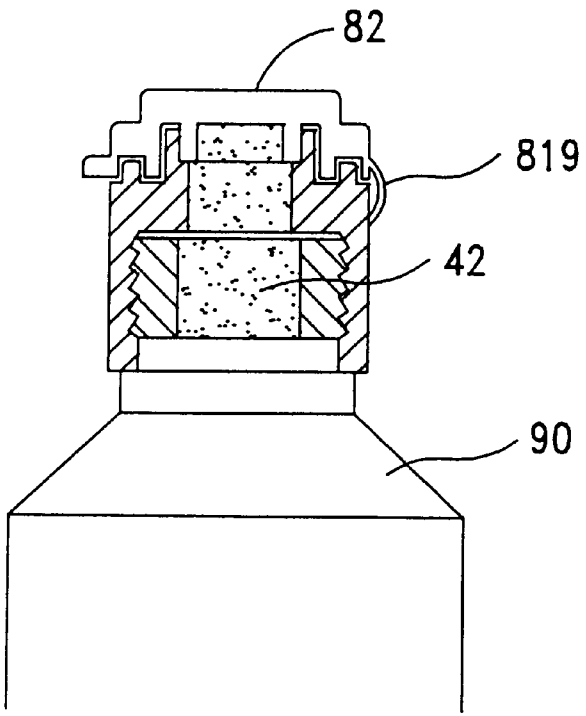
FIG. 8*d* is a section view of the mounting of a venting flip-cap on a toothpaste tube with a hinged cover at a closed position.
Figure 8C:
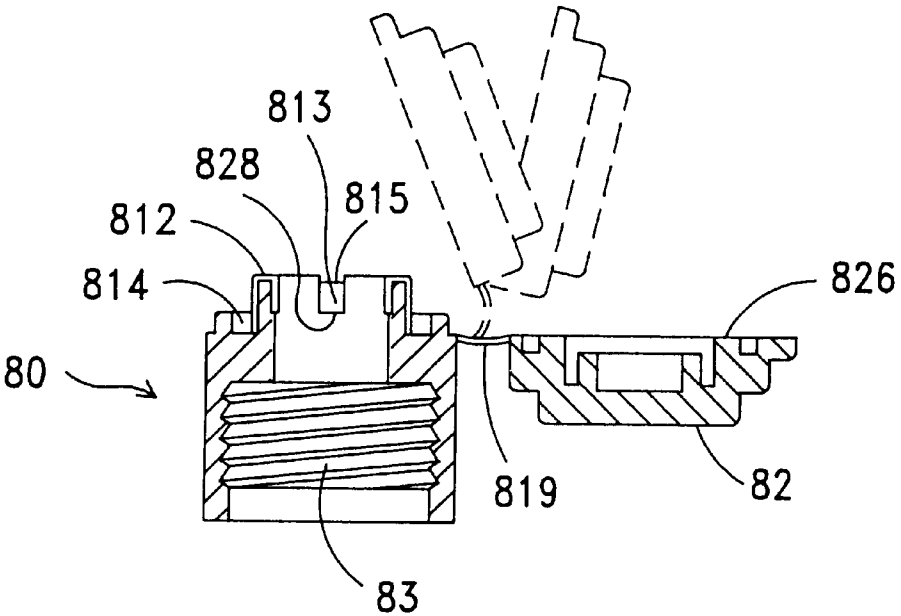
FIG. 8*c* is a section view of a venting flip-cap showing a hinged cover at different positions.
Figure 9A:
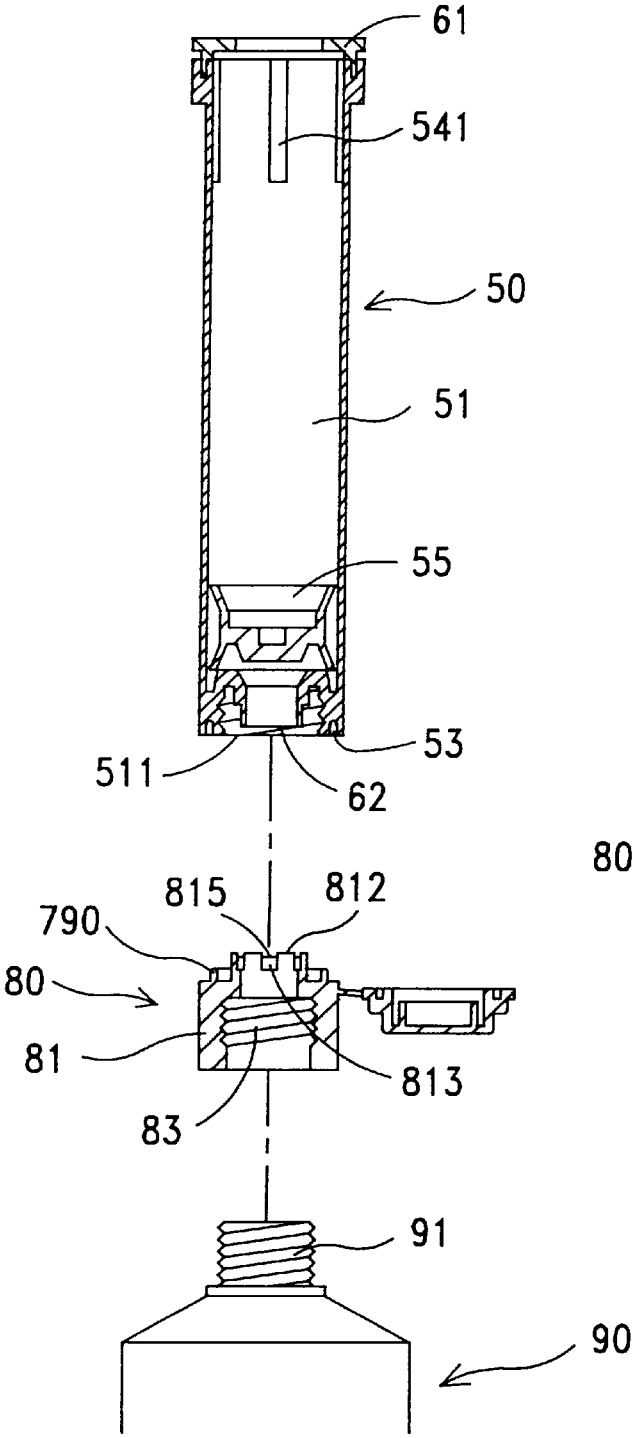
FIG. 9*a* is a sectional view of a refillable cartridge and a venting flip-cap and a planar view of a toothpaste tube prior to mounting for filling.
Figure 9B:
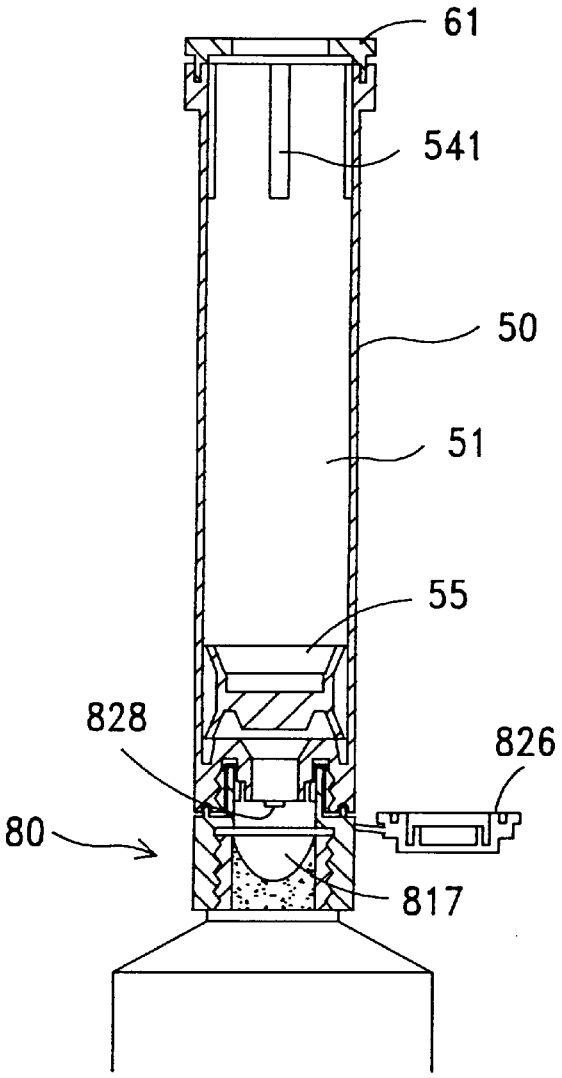
FIG. 9*b* shows a section view of a refillable cartridge positioned on and inserted into the top opening of a venting flip-cap screwed on a toothpaste tube showing entrapped air at the top opening area.
Figure 9C:
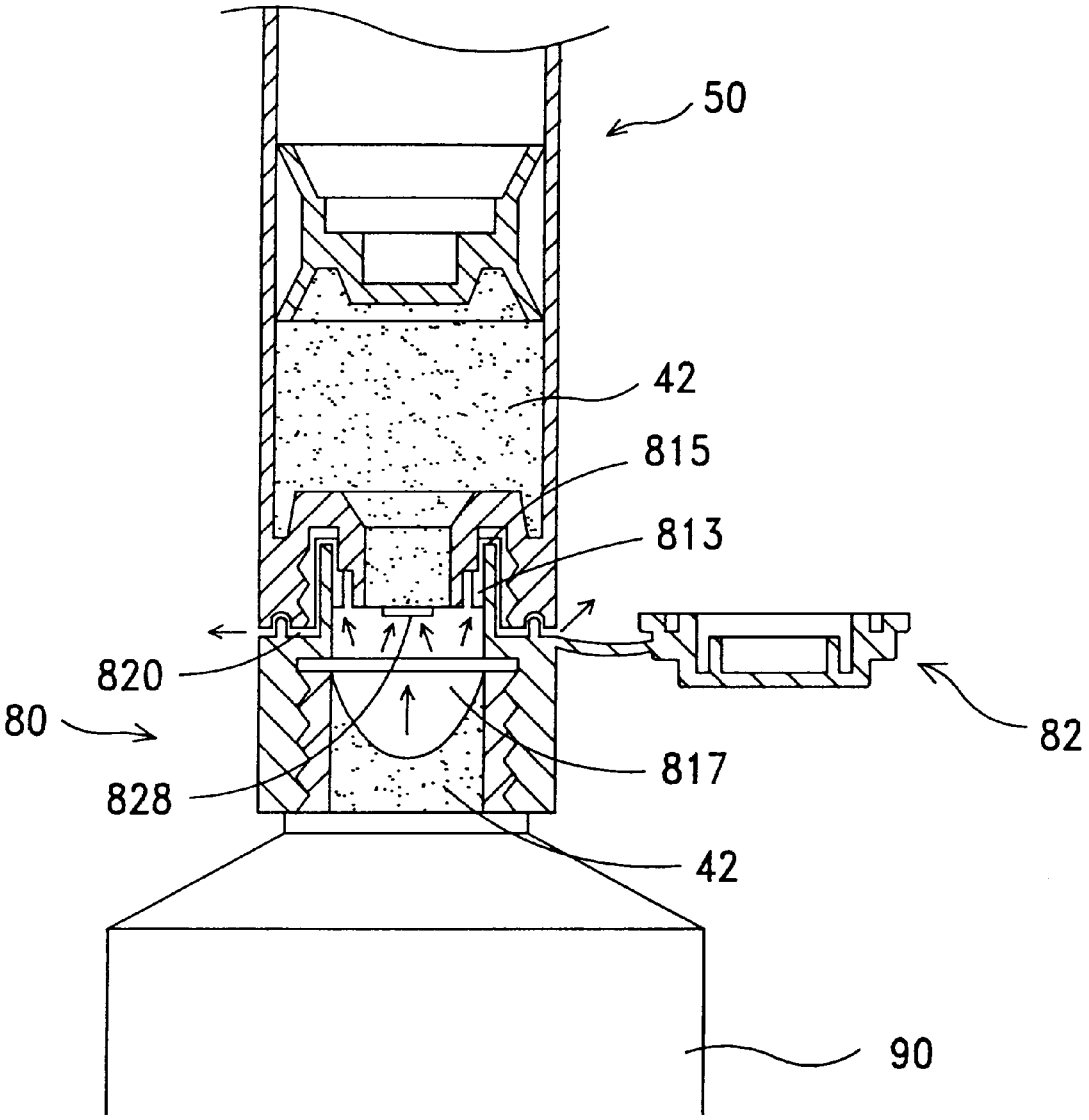
FIG. 9*c* is a schematic section view of FIG. 9*b* showing movement of the toothpaste flow and the venting of entrapped air through the vent grooves.

The necessity to push the toothpaste to the brink of the toothpaste tube to expel air prior to the mounting of a cartridge is inconvenient and may sometime be ignored by users. To eliminate this step and still be able to vent the air in the junction area of a refillable cartridge and a toothpaste tube, a special venting flip-cap 80 as shown in FIGS. 8*a*, 8*b*, 8*c* and 8*d* is used. Threaded base 83 of venting flip-cap 80 is screwed onto the threads 91 of toothpaste tube 90 shown in FIGS. 9*a* and 9*b*. Referring to FIGS. 8*b* and 8*c*, shallow vent grooves 813 are disposed on the interior surface 84 of the outlet opening rim 812 of venting flip-cap 80. Vent grooves 813 are covered by the first annular rim 522 or the second annular rim 521 of stepped annular lip 62 of refillable cartridge 50 (FIG. 5*a*) when mounted. The length of vent grooves 813 is slightly greater than that of stepped annular lip 62 of cartridge 50 such that inward ends 828 of vent grooves 813 can be exposed to air pocket 817 as shown in FIG. 9*b* and the depth of vent grooves 813 is small enough to ensure that only air and no toothpaste escapes when the toothpaste tube 90 is squeezed to fill cartridge 50. Notch areas 815 at outlet opening rim 812 provide air path 820 as shown in FIG. 9*c* to the atmosphere for venting when cartridge 50 is engaged. As shown in FIGS. 8*a* and 8*d* hinged cover 82 is not only for enclosing outlet opening rim 812, but also for wiping off any residual toothpaste on vent grooves 813 (resulting from other uses such as directly dispensing to conventional toothbrushes) by corresponding mateable ribs 827 positioned on inner ribbed annular rim 826 of hinged cover 82. The length of ribs 827 is greater than that of vent grooves 813 to ensure that tips 823 of ribs 827 can plow off any toothpaste remaining at the inward ends 828, which become entrances of the vent grooves 813 when the rest of the grooves are overlapped by the stepped annular lip 62 of the refillable cartridge. The position accuracy of the mating of vent grooves 813 and ribs 827 is ensured by hinge 819, which is an integral part of the venting flip-cap 80. FIG. 9*b* shows the entrapment of air 817 when a refillable cartridge 50 is mounted on venting flip-cap 80 which is screwed onto a toothpaste tube 90 which has not been squeezed to expel air prior to mounting of the refillable cartridge. However, entrapped air 817 is released through the vent grooves 813, notches 815 and other clearance between venting flip-cap 80 and cartridge 50 when the toothpaste is pushed forward to fill the cartridge as shown in FIG. 9*c*.

Figure 10A:
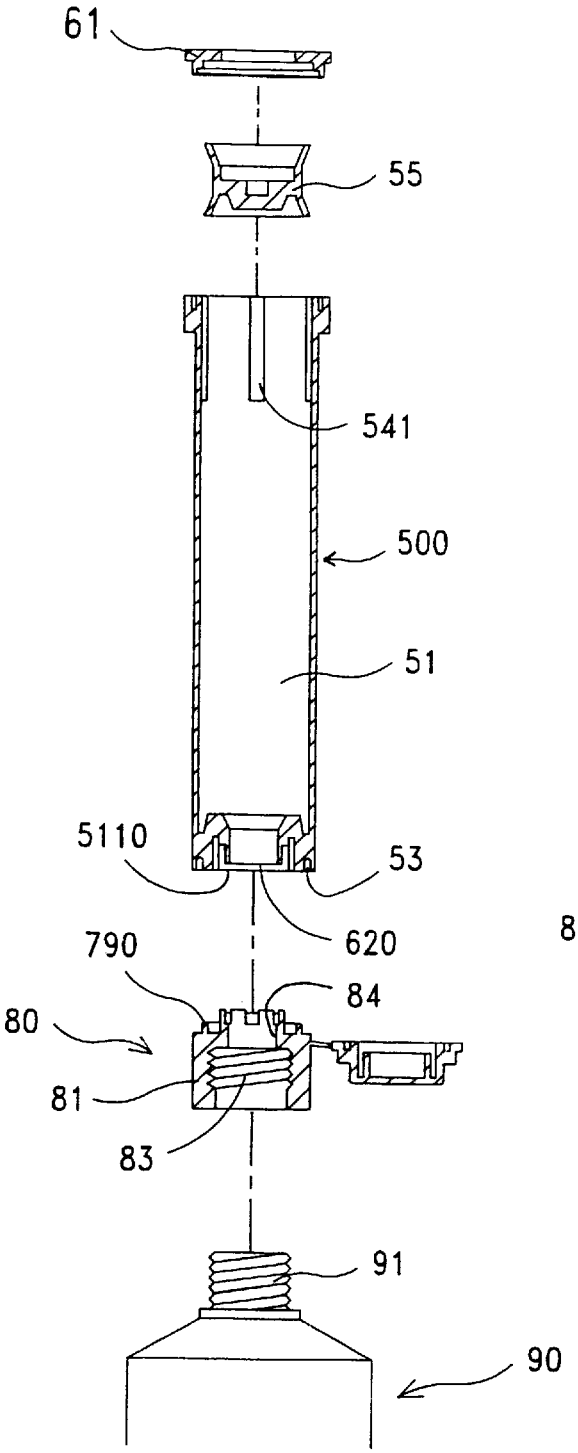
FIG. 10*a* is a section view of the components of a refillable cartridge having a non-threaded top opening end for linear insertion into a long handle housing.
Figure 10B:
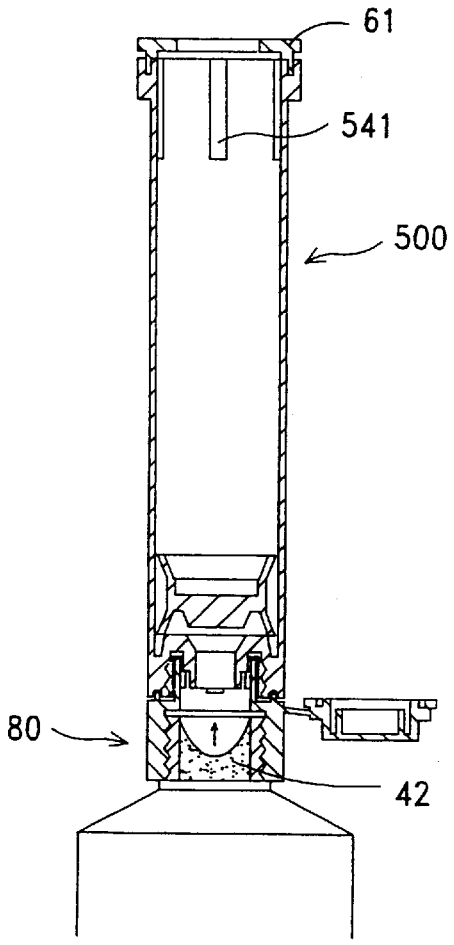
FIG. 10*b* is a section view of a refillable cartridge similar to FIG. 10*a* mounted on a venting flip-cap.
Figure 10C:
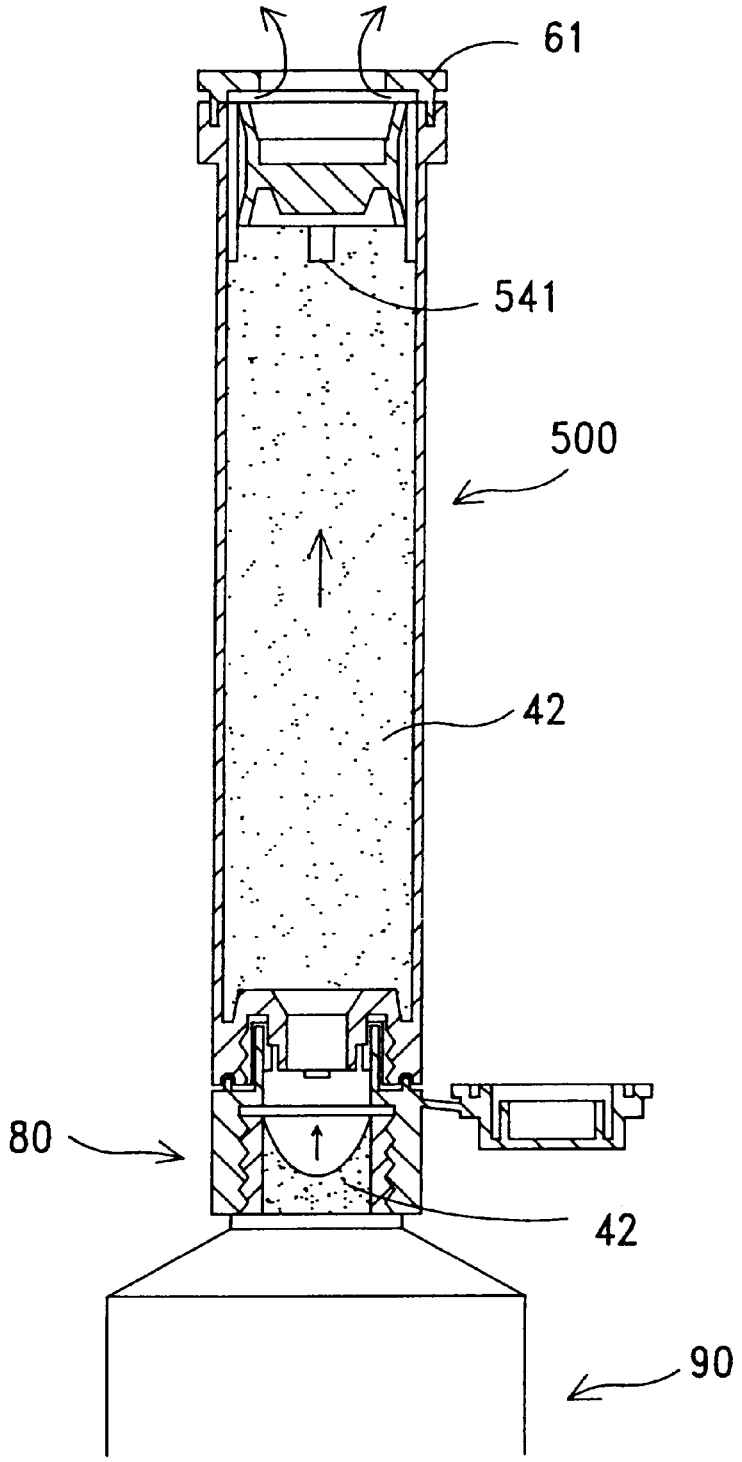
FIG. 10*c* is a schematic section view of a refillable cartridge similar to FIG. 10*b* with the follower disc reaching the bottom opening end of the cartridge showing venting of entrapped air.
Figure 11A:
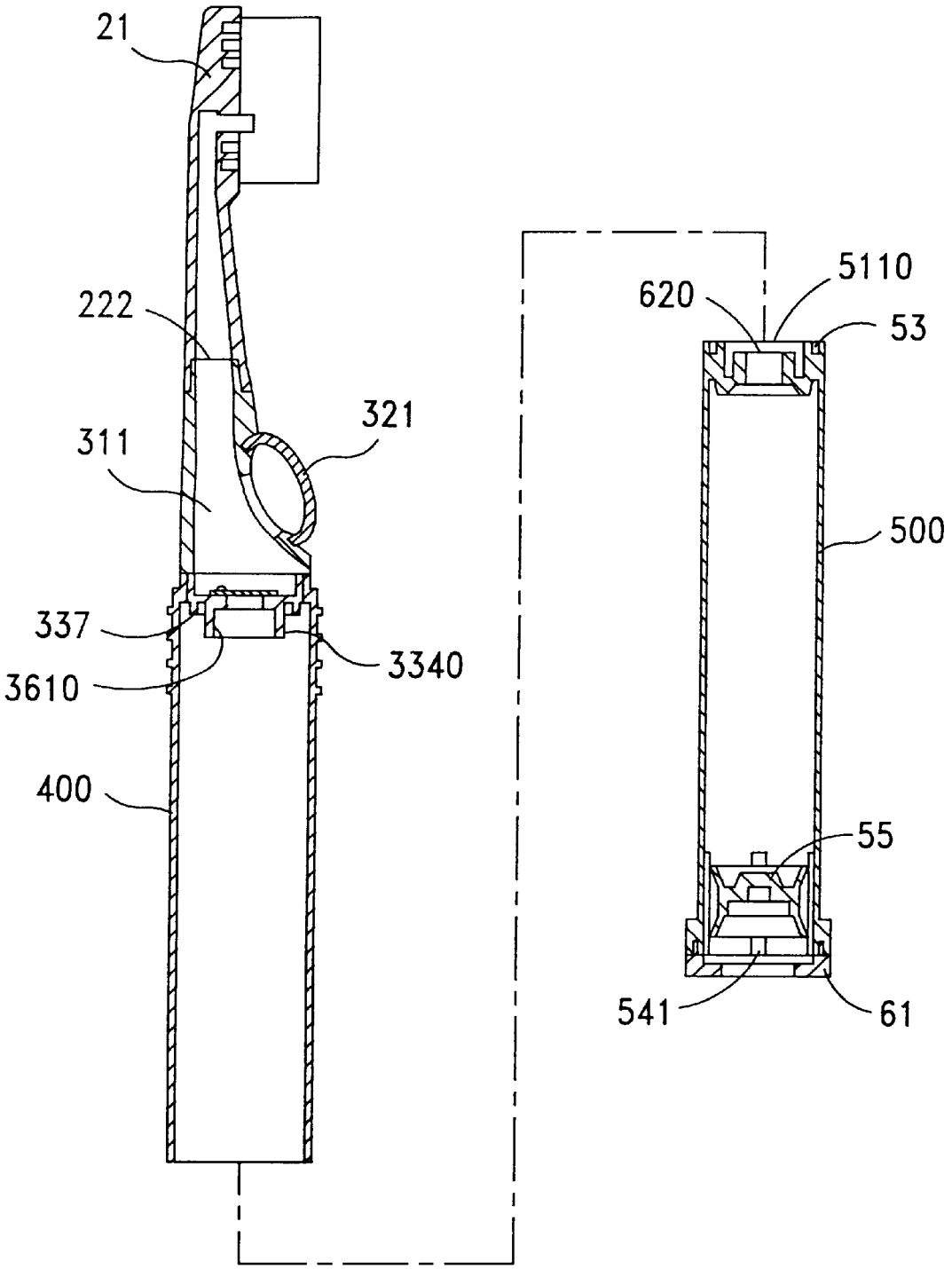
FIG. 11*a* is a section view showing a toothbrush having a separable brush head attached to the long handle housing with a refillable cartridge removed.
Figure 11B:
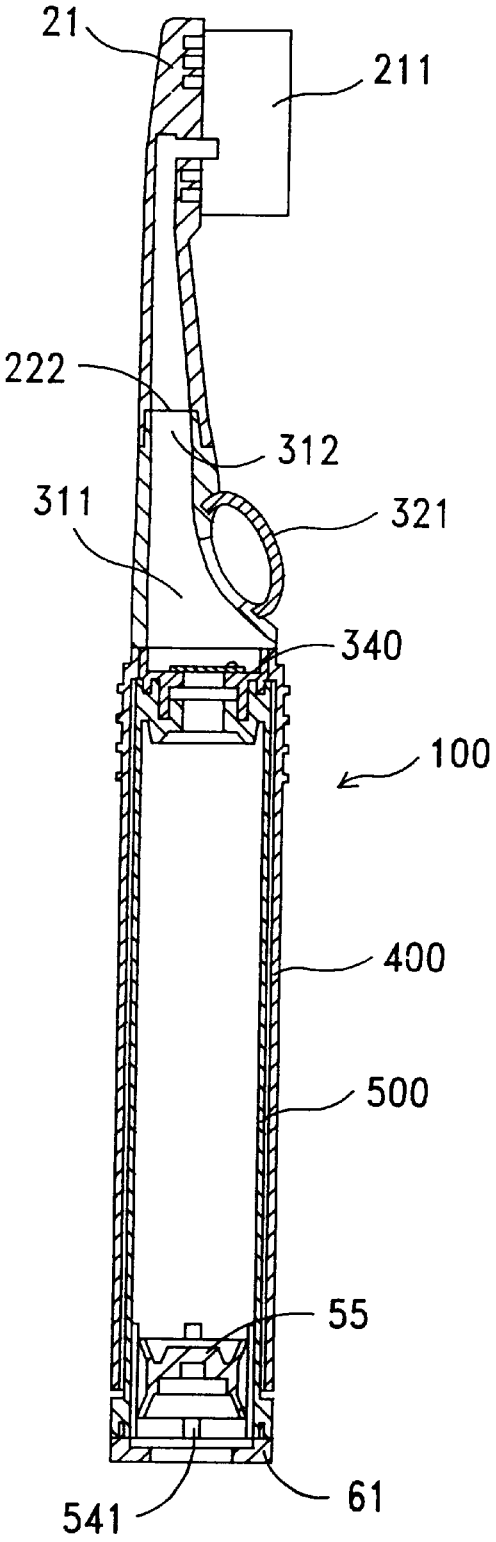
FIG. 11*b* is a section view showing a toothbrush similar to FIG. 11*a* having a refillable cartridge inserted into a long handle housing.

With the use of a venting flip-cap for filling a refillable cartridge as describe above, an alternative structure for a refillable cartridge includes a top opening end which is not threaded and has a single non-stepped annular lip, and an annular groove for mounting on a venting flip-cap for filling and for mating with a non-threaded base of a pump chamber for pumping. FIG. 10*a* shows a configuration of top opening end 5110 of refillable cartridge 500. The outside diameter of straight annular lip 620 and first annular groove 53 are mateable with the corresponding inside diameters of the interior wall 84 of outlet opening rim 812 and outer annular rib 790 of venting flip-cap 80, respectively, for snug-fit. As shown in FIG. 11*a* and 11*b*, similarly, the external annular rim 337 and recess 3610 of pump chamber base 3340 fit snugly with outer annular groove 53 and annular lip 620 of cartridge 500 respectively. The height of annular lip 620 is less than the length of vent grooves 813 on interior wall 84 (FIG. 10*a*) of venting flip-cap 80 such that the inward ends 828 of vent grooves 813 are exposed to the entrapped air when the annular lip 620 is inserted to overlap on grooves 813. The other filling and operation steps are similar to the thread-type refillable cartridge having a stepped annular lip as described previously. Again, referring to FIG. 11*a* and 11*b*, the application of this linear type of mounting of the refillable cartridge 500 is for a toothbrush 100 having a long handle housing 400 where the whole cartridge 500 is stored inside the housing 400 without the use of threads for fastening. In this long handle housing configuration, brush head 21 is made separable at junction 222 from long handle housing 400 as shown in FIG. 11*a*. As no rotation is required for this linear-type mounting, the cross-sectional profile of the cartridge and the handle housing can be non-circular or oval shape which may be preferred for better hand grip for brushing.

Figure 11D:
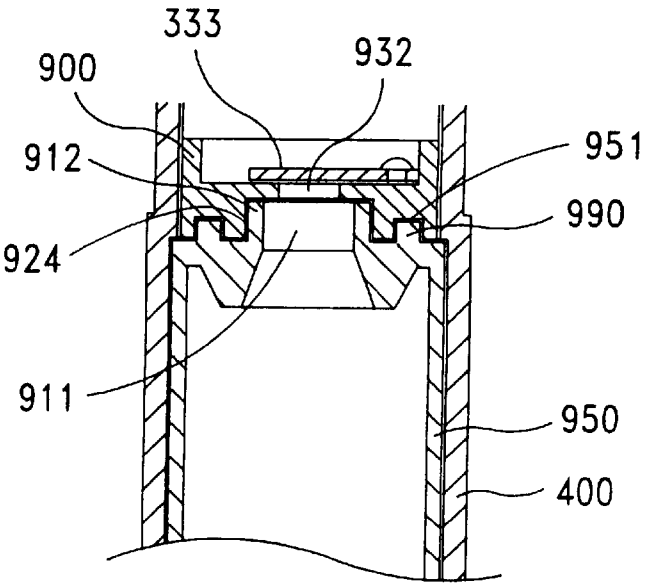
FIG. 11*d* shows a section view of the engagement of the vent grooves of the refillable cartridge with the corresponding ribs in the pump chamber base inside a handle housing.
Figure 11C:
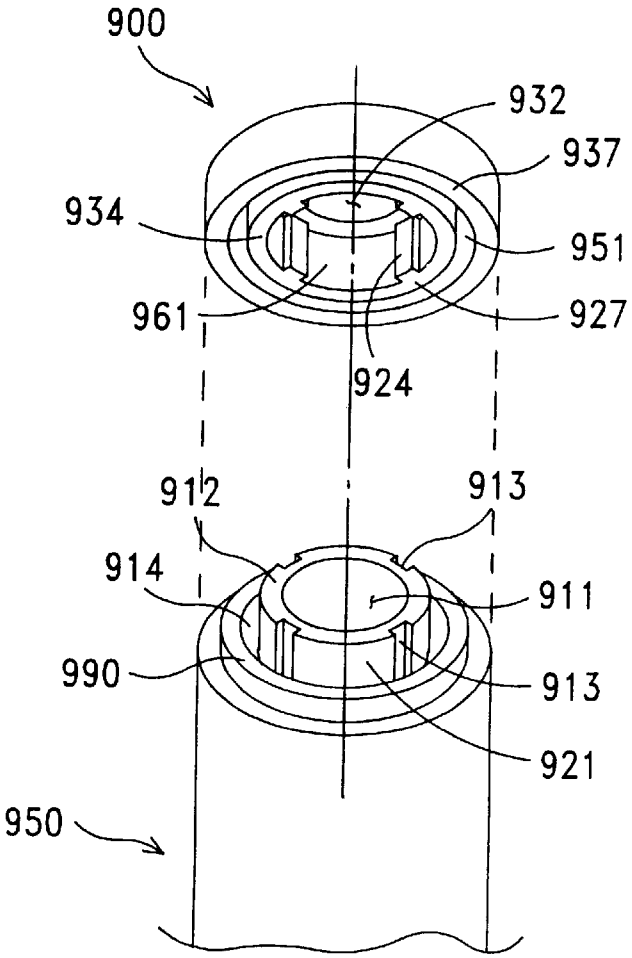
FIG. 11*c* shows perspective views of a refillable cartridge having vent grooves on the exterior surface of the annular lip and a pump chamber base having mateable ribs on its recess wall.

Similar to the concept of grooves in the venting flip-cap, the venting grooves can be placed on the external surface of the annular lip of the outlet opening of the refillable cartridge, which has vent grooves at the bottom opening end as described previously, and be mateable with the corresponding ribs placed on the recess wall on the exterior surface of the pump chamber base. The mating of the grooves with the ribs requires linear engagement, which can be conveniently achieved by using a conformable non-circular cross-sectional shape for both the cartridge and the handle housing. Referring to FIG. 11*c,* venting grooves 913 are placed on external wall 921 of annular lip 912 of outlet opening 911 of a refillable cartridge 950. These venting grooves 913 are mateable with the corresponding ribs 927 on the recess surface 961 of pump chamber base 900 for wiping off any residual toothpaste material remaining in the grooves when refillable cartridge 950 is inserted into handle housing 400 and engaged with pump chamber base 900 of a refillable dentifrice dispensing toothbrush as shown in FIG. 11*d.*

Figure 11E:
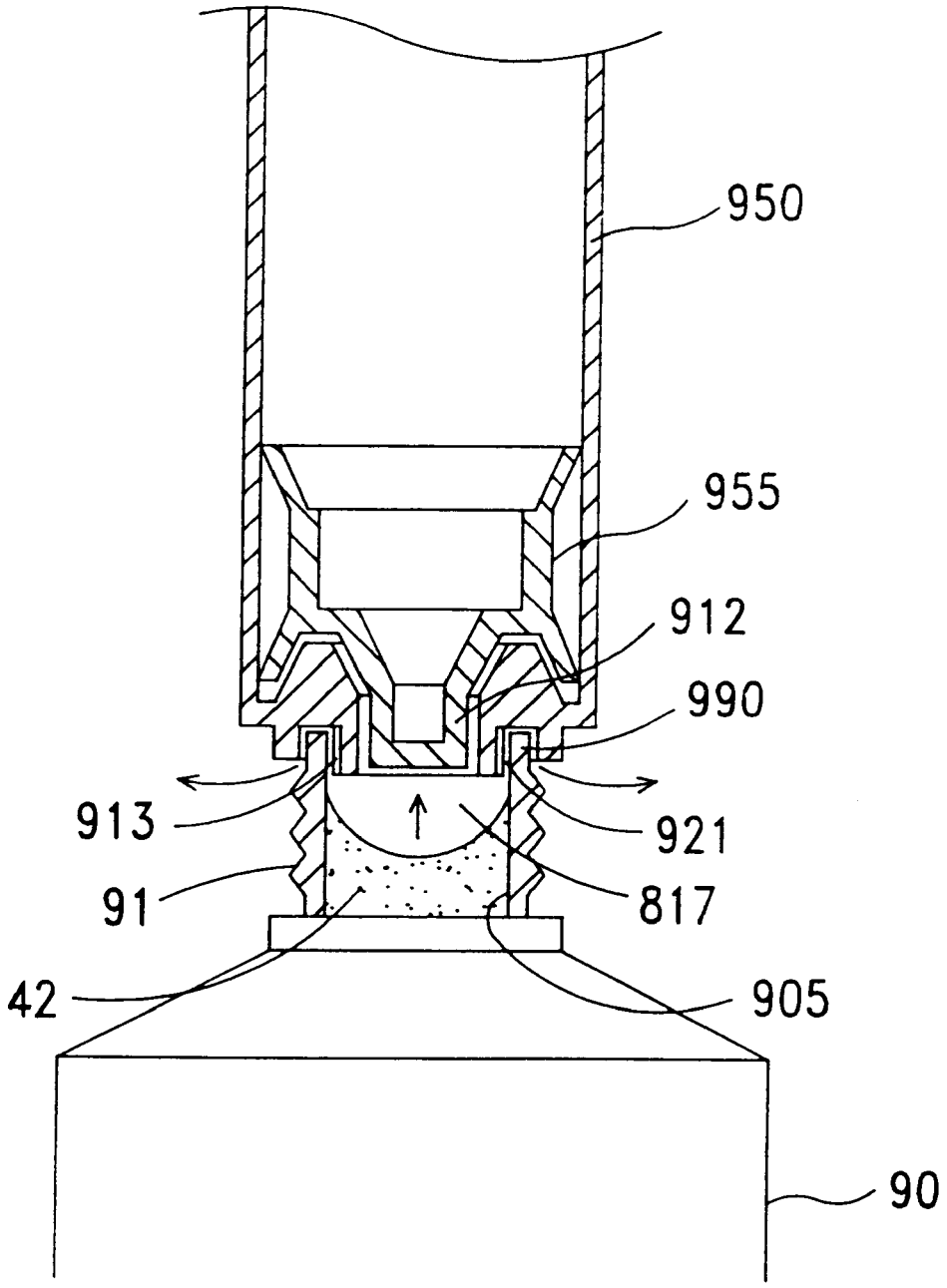
FIG. 11*e* is a cross-section view showing the mounting of a refillable cartridge having vent grooves on external surface of the annular lip matched with the inside diameter of the outlet opening of a toothpaste tube.

As further shown in FIG. 11*e,* when annular lip 912 of refillable cartridge 950 having two-way follower 955 at its top opening end is inserted into the outlet opening of toothpaste tube 90, its venting grooves 913 form vent channels against the inner wall 905 of the outlet opening of toothpaste tube 90 to enable the entrapped air in the junction area to escape but prevent the passage of dentifrice material.

Figure 12:
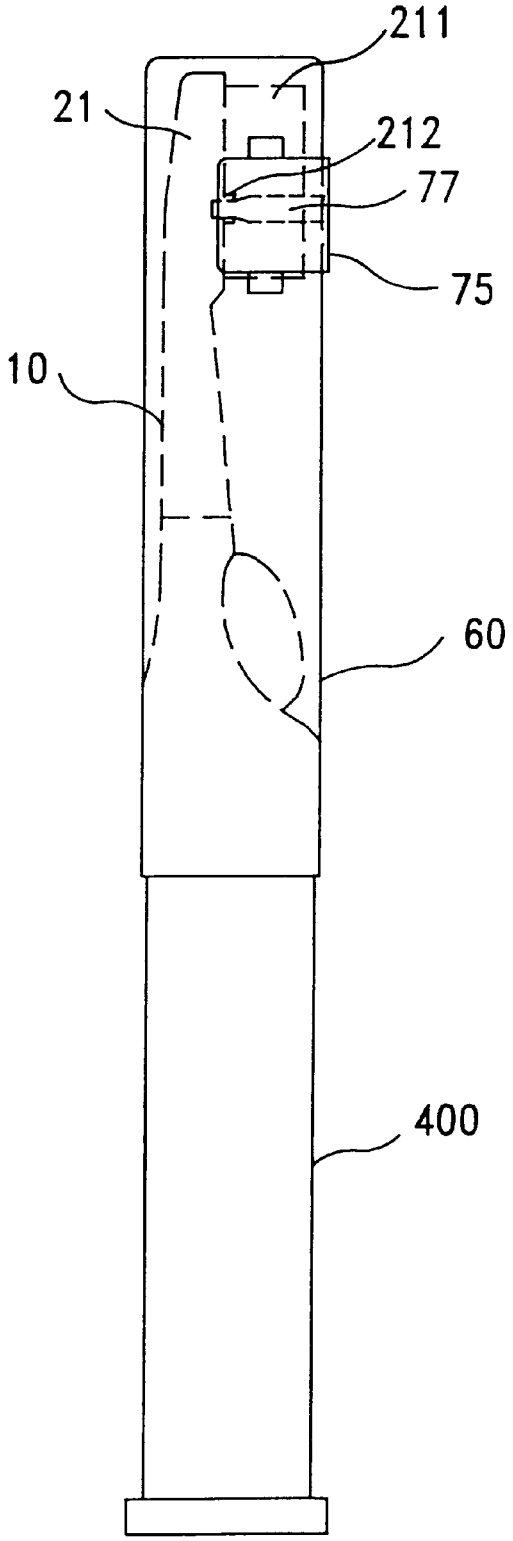
FIG. 12 is a side view of a toothbrush in one embodiment of this invention mounted with a cover having a slidable plug inserted into the spout of the brush head for sealing.

To prevent drying of the dentifrice material at the spout opening of the brush head, a brush cover 60 with a slidable plug 75 as shown in FIG. 12 is provided. The diameter of sealing rod 77 is such that it can be inserted into spout opening 212 to seal the opening so that dentifrice material does not dry out and clog the opening. The features of the brush cover are user friendly. The pre-aligned position of plug 75 and sealing rod 77 in relation to spout opening 212 ensures that the user will readily be able to seal the spout opening 212 merely by pressing plug 75 downward after brush cover 60 is closed. Brush cover 60 is locked when sealing rod 77 is positioned in spout opening 212. Removal of the brush cover and the plug is accomplished simply by pulling the plug upward to disengage the sealing rod from the spout opening and then moving the assembly in the axial direction. Alternatively while still being engaged in the spout of the brush head, the plug can be automatically pulled out from the spout by a simple pulling action of the brush cover since the sealing rod is made of low friction plastic material and its lateral movement with respect to the brush cover is constrained by built-in side guides (not shown) on the outer wall of the brush cover.

The invention has been described in detail with reference to a preferred embodiment thereof. However, it will be understood that variations and modifications can be affected within the spirit and scope of this invention.

I claim:

1. A refillable dentifrice dispensing toothbrush comprising:

a. a brush head having a platform with an outlet opening therethrough and a series of bristles which are attached to the platform;

b. a pump assembly comprising:

i. a pump chamber having (a) a base having an interior surface, an exterior surface having a recess wall and an opening therethrough, (b) a side wall having an opening therethrough, and (c) a top comprising an opening which is in communication with the outlet opening through the platform of the brush head;

ii. a depressible pump actuator attached to the side wall opening of the pump chamber for supplying a pumping force to dentifrice material stored in the pump chamber when the pump actuator is depressed;

iii. a flap check valve attached to the interior surface of the base for closing the opening in the base when the pump actuator is depressed;

c. a handle housing adapted for attachment of a refillable cartridge for storing dentifrice material, said handle housing being defined by a top which is attached to the exterior surface of the pump chamber, an open bottom and a side wall extending from the top to the open bottom;

d. a refillable cartridge containing dentifrice material which is adapted to be attached to the handle housing, said refillable cartridge being comprised of:

i. a cylindrical tube having an inner surface and an outer surface, said cylindrical tube terminating at a bottom opening end having a base and a top opening end which is in communication with the opening in the base of the pump chamber when the refillable cartridge is attached to the handle housing, said top opening end having a peripheral annular lip positioned around the top opening;

ii. a two-way follower disc positioned inside the cylindrical tube, said follower disc having an upper annular rim and a lower annular rim positioned to form a sliding fit against the inner surface of the cylindrical tube for sealing dentifrice material;

iii. a plurality of vent grooves positioned on the inner surface of the cylindrical tube and extending to the bottom open end, the length of the vent grooves being greater than the height of the follower disc, and the depth of said vent grooves being sufficiently small to prevent the flow of dentifirice material therethrough.

2. The refillable dentifrice dispensing toothbrush described in claim 1 wherein the attachable, refillable cartridge contains an end cap attached to the cartridge base for stopping the movement of the follower disc when the cartridge is detached and is being filled with dentifrice material, said end cap having an opening which is smaller in diameter than the bottom open end of the cartridge.

3. The refillable dentifrice dispensing toothbrush described in claim 1 including a venting flip cap wherein the top opening end of the refillable cartridge is connected to an outlet opening of the venting flip cap when the cartridge is detached from the handle housing for refilling purposes, said venting flip cap comprising:

a. a threaded base for mounting on a toothpaste tube opening which has threads on the exterior surface of the tube opening;

b. an outlet opening rim having (1) a sidewall which defines a flow channel and is connected to the threaded base, and (2) an edge which defines the outlet of the flow channel, said outlet opening rim having an exterior surface and an interior surface which is adapted to be mated with the exterior surface of the peripheral annular lip in the top opening end of the refillable cartridge;

c. a plurality of vent grooves disposed on the interior surface and extending inward from the edge of the outlet opening rim, the depth of the grooves being sufficiently small to permit the passage of air but prevent the passage of dentifrice material; and d. a hinged cover connected to the sidewall, said hinged over having (1) an annular rim for inserting into the outlet opening rim and (2) ribs positioned on the annular rim which are parallel to the axis of the annular rim for mating with the corresponding vent grooves on the outlet opening rim for cleaning off any dentifrice material in the vent grooves of the outlet opening rim.

4. The refillable dentifrice dispensing toothbrush described in claim 3 wherein the exterior surface of the outlet opening rim of the venting flip-cap has vent grooves connected to the vent grooves disposed on the interior surface of the outlet opening rim for providing air paths for releasing entrapped air when the annular lip of the top opening end of the refillable cartridge is inserted into said outlet opening rim of the venting flip-cap.

5. The refillable dentifrice dispensing toothbrush described in claim 1 in which the peripheral annular lip in the top opening end has a first annular rim and a second annular rim of different outside diameters where either the first annular rim or the second annular rim is mateable with the interior surface of the outlet opening of a toothpaste tube.

6. The refillable dentifrice dispensing toothbrush described in claim 1 wherein the top opening end of the refillable cartridge has an annular wall extension with interior threads for mating with the exterior threads of a toothpaste tube spout.

7. The refillable dentifrice dispensing toothbrush described in claim 1 in which the pump actuator is a dome-shaped resilient, elastic, compressible button having its base attached to the sidewall opening of the pump chamber, said resilient button returning to its original shape when an applied pumping force is released.

8. The refillable dentifrice dispensing toothbrush described in claim 1 in which the outside diameter of the upper annular rim of the follower disc of the refillable cartridge is less than the inside diameter of the cylindrical cartridge tube when the follower disc is not placed inside the cylindrical cartridge tube, and the outside diameter of the lower annular rim of the follower disc is slightly greater than the inside diameter of the cylindrical cartridge tube when the follower disc is not placed inside the cylindrical cartridge tube.

9. The refillable dentifrice dispensing toothbrush described in claim 1 wherein the exterior surface of the peripheral annular lip positioned around the opening at the top opening end of the refillable cartridge has shallow grooves for venting entrapped air when mounted on the inner surface of the outlet opening of a toothpaste tube and said shallow grooves are mateable with corresponding ribs positioned on the recess wall on the exterior surface of the pump chamber base for wiping off residual dentifrice material in the said grooves.

10. A venting flip-cap adapted to be attached to an outlet opening of a toothpaste tube and mated with an opening in a refillable cartridge of a dentifrice dispensing toothbrush, said venting flip-cap being comprised of:

a. a threaded base for mounting on a toothpaste tube opening which has threads on the exterior surface thereof;

b. an outlet opening rim having (1) a sidewall which defines a flow channel and is connected to the threaded base, and (2) an edge which defines the outlet of the flow channel, said outlet opening rim having an exterior surface and an interior surface which is adapted to be mated with the opening in a refillable cartridge;

c. a plurality of vent grooves disposed on the interior surface and extending inward from the outlet opening rim, the depth of the grooves being sufficiently small to permit the passage of air but prevent the passage of dentifrice material when mounted to a refillable cartridge; and d. a hinged cover connected to the sidewall, said hinged cover having (1) an annular rim for inserting into the outlet opening rim and (2) ribs positioned on the annular rim which are parallel to the axis of the annular rim for mating with the corresponding vent grooves on the outlet opening rim for cleaning off any dentifrice material in the vent grooves of the outlet opening rim.

* * * * *